US005215854A

United States Patent [19]

Yamazaki et al.

[11] Patent Number: 5,215,854

[45] Date of Patent: Jun. 1, 1993

[54] PROCESS FOR PRODUCING MICROCAPSULE TONER

[75] Inventors: Masuo Yamazaki, Kawasaki; Atsuko Kobayashi, Tokyo; Hitoshi Kanda, Yokohama; Yusuke Karami, Yokohama; Yasuhide Goseki, Yokohama; Yasutaka Akashi, Yokohama, all of Japan

[73] Assignee: Canon Kabushiki Kaisha, Tokyo, Japan

[21] Appl. No.: 417,071

[22] Filed: Oct. 4, 1989

[30] Foreign Application Priority Data

| | | | |
|---|---|---|---|
| Oct. 5, 1988 | [JP] | Japan | 63-249742 |
| Oct. 5, 1988 | [JP] | Japan | 63-249743 |
| Oct. 27, 1988 | [JP] | Japan | 63-269547 |
| Dec. 22, 1988 | [JP] | Japan | 63-321874 |
| Dec. 28, 1988 | [JP] | Japan | 63-329235 |

[51] Int. Cl.[5] ..... G03G 9/00; G03G 5/00; G03C 1/72

[52] U.S. Cl. ..... 430/137; 430/109; 430/110; 430/111; 430/138

[58] Field of Search ..... 430/138, 137, 109, 111, 430/110

[56] References Cited

U.S. PATENT DOCUMENTS

| | | | |
|---|---|---|---|
| 2,297,691 | 10/1942 | Carlson | 95/5 |
| 3,788,994 | 1/1974 | Wellman et al. | 252/62.1 |
| 3,941,898 | 3/1976 | Sadamatsu et al. | 427/18 |
| 4,016,099 | 4/1977 | Wellman et al. | 252/316 |
| 4,590,142 | 5/1986 | Yamazaki et al. | 430/138 |
| 4,599,294 | 7/1986 | Matsumoto et al. | 430/137 |
| 4,626,490 | 12/1986 | Yamazaki et al. | 430/138 |
| 4,656,111 | 4/1987 | Wakamiya et al. | 430/109 |
| 4,740,443 | 4/1988 | Nakahara et al. | 430/106.6 |
| 4,774,137 | 9/1988 | Alberts et al. | 428/407 |
| 4,797,344 | 1/1989 | Nakahara et al. | 430/138 |
| 4,828,955 | 5/1989 | Kasai et al. | 430/111 |
| 4,837,107 | 6/1989 | Axelsson et al. | 430/138 |
| 4,839,255 | 6/1989 | Hyosu et al. | 430/137 |
| 4,900,647 | 2/1990 | Hikake et al. | 430/137 |
| 4,904,562 | 2/1990 | Yusa et al. | 430/138 |

FOREIGN PATENT DOCUMENTS

| | | |
|---|---|---|
| EP238130 | 9/1987 | European Pat. Off. . |
| 0306330 | 3/1989 | European Pat. Off. . |
| 41-020153 | 11/1966 | Japan . |

(List continued on next page.)

OTHER PUBLICATIONS

Patent Abstract of Japan, vol. 12, No. 377 (P-768) (3224) on Oct. 7, 1988.

Patent Abstract of Japan, vol. 12, No. 323 (P-752) (3170) on Sep. 2, 1988.

Patent Abstract of Japan, vol. 13, No. 4 (P-809) (3352) on Jan. 9, 1989.

*Primary Examiner*—Marion E. McCamish

*Assistant Examiner*—Stephen Crossan

*Attorney, Agent, or Firm*—Fitzpatrick, Cella, Harper & Scinto

[57] ABSTRACT

A microcapsule toner is produced through the steps of: passing resinous base particles (A1) comprising at least a binder resin and modifier particles (B) having a particle size ratio of 0.2 or less with respect to the base particles (A1) through an impact zone having a minimum clearance of 0.5–5 mm between a rotating member and a fixed member or between at least two rotating members at an ambient temperature of 10°–90° C. thereby to fix the modifier particles (B) onto the surfaces of the base particles (A1) under the action of a mechanical impact force to form particles (A2), the modifier particles (B) being particles selected from the group consisting of charge-controlling particles releasing particles, colored particles, charge-suppressing particles and abrasive particles; and passing the particles (A2) and shell-forming resin particles (C) having a particle size ratio of 0.2 or less with respect to the particles (A2) through an impact zone having a minimum clearance of 0.5–5 mm between a rotating member and a fixed member or between at least two rotating members at an ambient temperature of 10°–90° C. thereby to fix the shell-forming resin particles onto the surfaces of the particles (A2) under the action of a mechanical impact force to form a shell, thus obtaining a microcapsule toner.

44 Claims, 7 Drawing Sheets

FOREIGN PATENT DOCUMENTS

| | | |
|---|---|---|
| 42-023910 | 11/1967 | Japan . |
| 43-024748 | 10/1968 | Japan . |
| 43-027596 | 11/1968 | Japan . |
| 44-006397 | 3/1969 | Japan . |
| 45-026478 | 9/1970 | Japan . |
| 55-042752 | 3/1980 | Japan . |
| 56-066857 | 6/1981 | Japan . |
| 58-041508 | 3/1983 | Japan . |
| 58-106554 | 6/1983 | Japan . |
| 59-007385 | 1/1984 | Japan . |
| 61-210368 | 9/1986 | Japan . |

PROCESS FOR PRODUCING MICROCAPSULE TONER

FIELD OF THE INVENTION AND RELATED ART

The present invention relates to a process for producing a microcapsule toner for developing electrostatic images in electrophotography, electrostatic recording and electrostatic printing.

Hitherto, a large number of electrophotographic processes have been known, as disclosed in U.S. Pat. No. 2,297,691 and Japanese Patent Publication (JP-B, KOKOKU) Nos. 23910/1967 and 24748/1968. Generally speaking, photoconductive materials are utilized in these processes and the steps included therein comprise forming electrical latent images on photosensitive members by various means, then developing the latent images by using a toner, transferring the toner images thus formed to a recording medium such as paper, as desired, and thereafter fixing the images by heating, pressure or solvent vapor to obtain copies.

As for copying machines in recent years, developing from conventional monocolor copying machines, two color or full color copying machines have been studied and commercialized.

Further, for the purposes of efficient copying operation, minimization of energy consumption, miniaturization of copying machines and higher copying speed, a low-temperature fixation toner capable of fixation with a small amount of heat and a pressure fixation toner capable of fixation at a further lower temperature are being also studied.

In most of the copying machines in recent years, the heat roller-type fixing system has been adopted, wherein the toner is fixed onto paper under heat and pressure by means of hot rollers.

In such heat and pressure fixation system, a heating member at a lower temperature can be used than in the non-contact-type heating system using heat rays, and a higher copying speed can be attained. This system still involves some problems, a major one of which is that if a hot roller is held at a sufficiently high temperature as to allow the sufficient fixation of the toner onto a toner-receiving member such as paper, the toner is attached by fusion not only onto the paper but also to the heat roller. As a result, the thus attached toner contaminates the hot roller in repetitive copying. Incidentally, such toner attached to the hot roller is not sufficiently removed by a blade or a cleaning web for cleaning the hot roller and is then retransferred onto subsequent paper sheets whereby the so-called "high-temperature offset phenomenon" may sometimes occur to contaminate the paper sheets.

In order to obviate or reduce the offset phenomenon, various attempts have been made in respects of both a fixing device and a toner, but further improvement has been desired.

Concerning the technique for improvement of the binder resin for toner, for example, Japanese Patent Publication (JP-B, KOKOKU) No. 23354/1976 (corresponding to U.S. Pat. No. 3,941,898) proposes a toner by using a crosslinked polymer (mainly of a styrene-type resin) as the binder resin. While this method has an effect of considerably improving anti-offset characteristic and anti-winding characteristic, the fixing point (temperature) is elevated by increasing the degree of the crosslinking. Particularly, when color or chromatic toners of respective colors are used to obtain a color copied image, such elevation of the fixing point considerably impairs the image quality. More specifically, not only the luster and the gloss of the image which are important characteristics of a color copied image are lost, but also reproducibility in color tones deteriorate. Further, the dispersibility of a colorant such as pigment in the above-mentioned crosslinked polymer is not good, whereby the developing characteristics of the toner also deteriorates because of the poor dispersibility of the colorant.

Further, Japanese Laid-Open Patent Application (JP-A, KOKAI) No. 106554/1983 proposes a method wherein monodisperse spherical core particles are coated with a polymer substance containing a colorant. In this method, e.g., the monodisperse spherical core particles are added into a solution comprising a solvent such as cyclohexane or methanol, and the polymer substance and the colorant dissolved or dispersed therein, and then the solvent is removed to coat the core particles. In this method, however, it is necessary to considerably suppress the amount of the polymer substance in the solvent, in order to obtain good coating. Further, a device for removing the solvent is required thereby to increase the production cost and to complicate the production steps. Further, it is technically difficult to prevent the agglomeration of the particles in the step of concentrating the solution, and there is required a special technique for preventing the agglomeration, or the disintegration of the agglomerates as disclosed in the above-mentioned publication. Moreover, while the core particles are required not to be dissolved in the solvent, the coating polymer substance is required to be dissolved in the solvent. Accordingly, the materials of the core particles and the coating polymer substance are severely restricted.

On the other hand, there has been proposed another method wherein core particles are coated by using a dispersion (mainly of an aqueous dispersion) comprising a polymer substance and a colorant. In such method, similarly as in the above-mentioned method using a solvent, it is necessary to use a device for removing water, whereby the production cost increases. Further, it is technically difficult to prevent the agglomeration of the particles in the step of concentrating the dispersion, and it is also necessary to use an additive such as an emulsifier in order to disperse the highly hydrophobic core particles in water. The emulsifier is generally a hydrophilic substance which impairs the triboelectric chargeability of a high insulation-type toner, particularly under a high-humidity condition. Accordingly, it is necessary to remove the emulsifier, but the removal thereof is technically difficult. As a result, it is preferred to coat the core particles without using the emulsifier.

Further, there has been proposed a method wherein core particles are coated by fusing powders of a polymer substance and a colorant by heating. In this method, it is necessary to adjust the temperature to one which is sufficiently low so as to suppress the thermal agglomeration of the core particles as perfectly as possible, and which is sufficiently high so as to bond the polymer substance as a coating material to the core particles. Such adjustment of the temperature, which intends to prevent the thermal fusion of mutual core particles, is very important. However, in this thermal fusion of the polymer substance as the coating material, the core particles significantly heat-fuse. The reason for this is as follows: A toner used in electrophotography provides a copy through a process wherein the toner image is transferred to a recording medium such as paper and then fixed by heating, pressure, or heating and pressure. Because the toner is required to melt by heating and/or pressure in such fixing step, the material of the core particles mainly comprises a thermoplastic resin.

In a case where the polymer substance is attached to the entire surfaces of the core particles, even when the core particles are heat-melted, the agglomeration thereof may be prevented to some extent because of the shell of the polymer substance. However, in a case where the coating substance is partially attached to the surfaces of the core particles, it is difficult to prevent the thermal agglomeration of the core particles due to the thermal fusion thereof. Further, in this method, it is technically difficult to prepare a toner wherein the core particles are partially coated with the coating substance.

JP-A (KOKAI) No. 210368/1986 proposes a method wherein a binder resin and a colorant are dispersed on the surfaces of spherical core particles by means of a mixer such as a Henschel mixer and a Super Mixer, and the binder resin and the colorant are fixed to the core particles by heat-treating the resultant mixture at a temperature which is lower than the softening point of the spherical core particles and is higher than that of the binder resin. In this method, however, it is necessary in view of materials, that the softening point of the binder resin is lower than that of the spherical core particles. Further, when the spherical core particles are heat-treated at a temperature of 110°-140° C for 10 min. as disclosed in the specific example of the above-mentioned application, it is technically difficult to prevent the thermal agglomeration or thermal fusion of the spherical core particles. Further, the materials used can be deteriorated by heating depending on the property thereof. Accordingly, the problems have not yet been sufficiently solved in the prior art.

As mentioned above, there has been desired a color toner which has sufficient anti-high-temperature-offset characteristics and sufficient releasability to a hot fixing roller, and has wide color-reproducibility so as to provide good developing characteristics and suitable gloss as a color image.

Toner particles are generally composed of materials, such as a binder resin, a colorant, a charge controller and a release agent. In the toner production by the pulverization process, these materials are blended, melt-kneaded in a kneading means such as a roll mill and pulverized into fine particles by means of a pulverizer such as a cutter mill, a pin mill and a jet mill. At this time, various materials can be present at the surfaces of the toner particles. If the colorant, for example, is present on the toner surface, the chargeability is impaired and moisture adsorption is increased to deteriorate the developing performance of the toner. A colorant isolated during the pulverization can contaminate the carrier and the developing sleeve. Binder resins with a low-melting point or waxes used in a low-temperature-fixable toners or pressure-fixable toners have contradictions in that they are preferred with respect to fixing characteristic, but provide undersirable effects to anti-blocking characteristic or durability of a toner.

As a form of toner solving these problems, a microcapsule-type toner has been proposed as shown in U.S. Pat. Nos. 4,016,099 and 3,788,994. A microcapsule toner is a form of toner wherein a core particle comprising materials such as a binder resin and a colorant is enclosed within a harder film called an (outer) shell having a chargeability. By using such a form of particle, the problems caused by a binder resin and a colorant as described above can be compensated. There have been many proposals about such a microcapsule toner. Known methods for producing microcapsule toners include spray drying, interfacial polymerization, coacervation, phase separation and insitu polymerization. However, a desirable microcapsule toner cannot be easily obtained by the above-mentioned methods even if materials having desirable functions are used. In many cases, there are involved problems, such as incompleteness of film formation, coalescence of microcapsule toner during the production, and also a high production cost. A microcapsule toner used in the pressure fixing system generally uses a binder resin comprising a waxy material, but it is very difficult to disperse a colorant in a waxy material, so that it is difficult to produce a color toner with a wide color reproducibility.

As methods for charging a toner or a microcapsule toner, there have been known several methods including the charge injection method wherein an electroconductive toner is used for charge injection, the dielectric polarization method wherein dielectric polarization under an electric field is utilized, the ion beam charging method wherein the particles are showered with charged ions, and the triboelectric charging method wherein a toner is subjected to friction with a member having a different position in the triboelectric chargeability series. Among these, the triboelectric charging method is widely used at present because insulating toner particles are controlled to have a sufficient charge with a good reproducibility. However, as the triboelectric charge is proportional to the amount of frictional work, it is impossible to always uniformize the amount of frictional work applied to individual toner particles in a practical developing system. Accordingly, the resultant charge is liable to be excessive or insufficient and affected by change in ambient conditions, particularly humidity.

If a toner is provided with a rapid or steep triboelectric charging characteristic, the magnitude thereof is also liable to be increased, so that it becomes necessary to form a large electric field for transferring the toner particles to the surface having latent images because of the excessively large charge especially under the low-humidity condition. This leads to a large load on the system and a risk of discharge due to dielectric breakdown. On the other hand, if the magnitude of a triboelectric charge is suppressed, a long time is required to generate a sufficient charge especially under the high-humidity condition. It becomes impossible to prevent the particles from attaching to parts other than latent images due to some forces other than an electrical force, thus leading to poor image quality. This tendency is strong for a toner consisting generally of a highly insulating binder resin except for a small amount of colorant and a microcapsule toner comprising core particles covered with a highly insulating shell, but is relatively weak for a magnetic toner containing a magnetic material so as to be provided with a magnetism.

In the case of a magnetic toner, the magnetic material has a lower resistivity compared with the binder resin and excessive charge may be discharged from the magnetic material. This also holds true with other metal oxides, metal powder, semiconductors such as carbon black, conductors, low-molecular weight compounds such as dyes and pigments and surfactants in addition to the magnetic material described above. These materials provide some charge-suppressing or charge-leaking effect even on toner particles having surfaces composed of almost only a highly-insulating binder as described above.

Internal addition of such a charge-suppressing substance can change the required physical properties and coloring characteristic of toner particles and requires a large amount of such substrate. On the other hand, external addition of a charge-suppressing substance is effective at a small addition level and provides little undesirable effect. However, more blending of toner particles and externally added charge-suppressing fine particles having a remarkably different developing characteristic can lead to a change in mixing ratio of the toner and the charge-suppressing substance in a developer and consequently to a change in developing performance of the developer on continuation of the developing operation.

In a system wherein a toner particle image on a latent image-bearing surface is transferred to another member and then the latent image-bearing surface is cleaned for repetitive use, it is possible that a charge leaking substance is not transferred but gradually accumulates at the cleaning position to damage the image-bearing surface or cleaning member while it is attached to the materials of these members. For this reason, it is necessary that the charge-suppressing fine particles are securely fixed onto the toner surface.

Hitherto, especially under high temperature-high humidity conditions, there has been observed a problem of image flow due to melt-sticking of a toner onto a photosensitive member caused by friction between the photosensitive member and a cleaning blade or by attachment of a low-resistivity substance such as paper dust. In order to prevent the image flow and toner sticking onto the photosensitive member under the high temperature-high humidity conditions, it has been known to add lubricative fine powder of PVdF or a fatty acid metal salt to a toner, aiming at facilitation of cleaning of a toner or a low-resistivity substance such as paper dust from the photosensitive member.

It is also known to externally add fine particles of an abrasive agent such as $CeO_2$ to a toner to provide the toner with an appropriate abrasive function so as to always polish the surface of the photosensitive member during cleaning. In this instance, however, the abrasive fine particles are merely attached to the toner surface electrostatically so that the abrasive function of the toner per se cannot yet be controlled. A considerable amount of particles are required, which may impair the toner chargeability. Because of electrostatic attachment, the toner and the fine powder are separated during development, and at that time, mutually opposite polarity charges are provided to each other. For this reason, it is necessary to pay full attention to the charging characteristic of the additive fine powder, and thereby only very limited substances can be accepted as usable.

It has been known that the abrasive function of a toner can be remarkably different depending on the molecular weight and gel content of the binder, the amount and shape of the magnetic material, and the kind and state of the dispersion of polyalkylene. Accordingly, it is of course possible to control the abrasive performance of the toner per se. If such a toner designing is performed, however, some troubles (development failure, transfer failure, offset, etc.) can be encountered in the development, transfer and fixing steps. Hitherto, these troubles in development, transfer and fixing steps have been dominanat, so that only a limited control of abrasive performance of a toner per se has been attempted by external addition of a lubricating agent and an abrasive agent while it is insufficient. As a result, the designing latitude of the step of cleaning a photosensitive member in a copying machine has been rather narrowed thereby.

It has been also a general practice to add a charge controller or charge controlling agent, in order to impart sufficient triboelectrical charging characteristic to the toner.

Positive charge controllers known in the art include compounds such as nigrosine, azine dyes, and quaternary ammonium salts. On the other hand, known negative charge controllers include compounds such as a metal complex on a monoazo dye, and a Co, Cr of Fe complex of salicylic acid. These charge controllers are usually added to a thermoplastic resin to be dispersed in the resin while it is molten under heating. The resultant resin mixture is micropulverized into fine particles and, if desired, adjusted to suitable particle sizes.

However, it is very difficult to disperse these charge controllers evenly into a thermoplastic resin, and their content in toner particles obtained by pulverization is not constant which results in different amounts of triboelectric charges among the toner particles. For this reason, in the prior art, various methods have been practiced in order to disperse the charge controller more evenly into a resin. For example, a basic nigrosine dye is formed into a salt with a higher fatty acid for improvement of compatibility with a thermoplastic resin. In this case, however, unreacted fatty acid or decomposed product of the salt will be exposed on the toner surfaces to contaminate carriers or toner-carrying member and also cause lowering in free flowing property of the toner, fog and lowering in image density. Alternatively, for improvement in dispersibility of these charge controllers into a resin, there is also employed a method in which a powder of a charge controller and resin powder are previously mechanically pulverized and mixed before fusion kneading. This method is not good enough to overcome the original poor dispersibility, and uniformity of charging which is satisfactory in practical application has not yet been obtained. Accordingly, there has been desired improvement for providing sufficient uniformity in the triboelectric charge.

Further, in order to prevent offset in hot-roller fixing, it has been also a general practice in recent years to add a release agent such as a polyolefin inclusive of polypropylene and polyethylene or paraffin wax. In order to further increase the anti-offset characteristic, it has been further tried to add a larger amount of the release agent or a release agent of a low-melting point. This however leads to a difficulty such as melt-sticking of the toner onto the pulverizer or the classifier.

Such an offset phenomenon is liable to occur when a low-molecular weight resin is used as disclosed in Japanese Patent Publication (KOKOKU) No. 23354/1976. Accordingly, it has been considered to prevent the offset by using a crosslinked resin as also disclosed by the publication. As a result of our study, in view of requirement for a further improved fixing characteristic, it is not necessarily appropriate to simply use a crosslinked resin. A higher crosslinking degree results in a higher fixing temperature and the increase in fixing temperature is noticeable particularly in case of a magnetic toner, thus leading to worsening of the anti-offset characteristic.

On the other hand, so as to prevent the attachment of a toner onto the surface of a fixing roller, it has been practiced to compose the roller surface of a material having a good release characteristic to the toner, such as silicone rubber or a fluorine-containing resin and to further coat the roller surface with a film of a liquid having a good releasability such as silicone oil for the purpose of preventing the offset and fatigue of the roller surface. This method is very effective for preventing the offset but involves problems in that the offset-preventing liquid causes unpleasant odor to the user due to evaporation under heating and a mechanism for supplying the offset-preventing liquid is required to complicate the fixing apparatus.

For the above reason, the method of preventing offset by supplying an offset preventing liquid is not preferred, but it is rather desired at present to develop a toner having a wide fixing temperature range and having a good anti-offset characteristic.

SUMMARY OF THE INVENTION

An object of the present invention is to provide a process for producing a microcapsule toner having solved the above-mentioned problems accompanying conventional toners.

A specific object of the present invention is to provide a process for producing a microcapsule toner free from or with little contamination of a carrier with the colorant. Another object of the present invention is to provide a process for producing a microcapsule toner which has a good fixing characteristic, a good durability, and a good storability without causing blocking.

A further object of the present invention is to provide a process for producing a microcapsule toner which has a good chargeability and a good developing characteristic.

An object of the invention is to provide a process for producing a microcapsule toner for electrophotography capable of providing color copy images having sufficient gloss and luster.

An object of the invention is to provide a process for producing microcapsule toner particles provided with improved charge-leaking characteristic, which have a quick triboelectric chargeability, are free from excessive charge and unstable charge due to changes in ambient conditions on repetitive use and have been improved so as to prevent damage to a photosensitive member and a cleaner in a system for repetitive use.

An object of the invention is to provide a dry process for producing a microcapsule toner which is free from filming on a photosensitive member, shows a good chargeability with time, and provides stable good images.

An object of the invention is to provide a process for producing a microcapsule toner which is uniformly and stably chargeable.

An object of the invention is to provide a process for producing a microcapsule toner for hot roller fixation which has a good fixing characteristic, particularly a good anti-offset characteristic.

A further object of the present invention is to provide a process for producing a microcapsule toner for hot roller fixation, which has a good and stable chargeability during use and provides clear images free from fog.

According to the present invention, there is provided a process for producing a microcapsule toner, comprising: passing resinous base particles (A1) comprising at least a binder resin and modifier particles (B) having a particle size ratio of 0.2 or less with respect to the base particles (A1) through an impact zone having a minimum clearance of 0.5–5 mm between a rotating member and a fixed member or between at least two rotating members at an ambient temperature of 10°–90° C. thereby to fix the modifier particles (B) onto the surfaces of the base particles (A1) under the action of a mechanical impact force to form particles (A2), the modifier particles (B) being particles selected from the group consisting of charge-controlling particles releasing particles, colored particles, charge-suppressing particles and abrasive particles; and passing the particles (A2) and shell-forming forming resin particles (C) having a particle size ratio of 0.2 or less with respect to the particles (A2) through an impact zone having a minimum clearance of 0.5 –5 mm between a rotating member and a fixed member or between at least two rotating members at an ambient of 10°–90° C. thereby to fix the shell-temperature forming resin particles onto the surfaces of the particles (A2) under the action of a mechanical impact force to form a shell, thus obtaining a microcapsule toner.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 8:
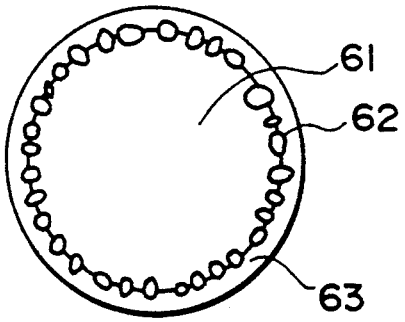
FIG. 8 is a schematic sectional view showing a microcapsule toner obtained in the present invention.

A particle of the microcapsule toner produced by the process according to the present invention assumes, e.g., a sectional structure as schematically shown in FIG. 8.

Referring to FIG. 8 through the process of the present invention, particles (B) 62 are fixed onto the surface of a particle (A1) 61 to form a particle (A2). Further, shell-forming resin particles (C) are attached to the particle (A2) and fixed onto the surface of the particle (A2) under the action of a mechanical impact to form an (outer) shell 63.

In order to uniformly fix the particles (B) or (C) onto the particles (A1) or (A2), respectively, the particles (A1) or (A2) may preferably be spherical particles with few projections.

During the mechanical impact application, a projection, if any, is preferentially subject to a force to cause noniform thermal deformation and is liable to be broken, thus being not desirable. On the other hand, particles (B) or (C) attached to concavities are less subjected to mechanical impact and are not readily fixed to the particles (A1) or (A2) to remain in an isolated form.

In contact thereto, spherical particles are subjected to a uniform impact and preferred.

The particles (B) may comprise charge-suppressing (or charge-leaking) particles, colored particles, charge-controlling (or charge-enhancing) particles, abrasive particles and/or releasing particles.

The case where the particles (B) comprise charge-suppressing particles is first explained.

In order to produce a toner having charge-suppressing fine particles attached to the surface thereof and having a sufficient charge-suppressing effect through internal addition of the charge-suppressing particles, i.e., blending, kneading and pulverization, it is necessary to add a large amount of the charge-suppressing particles.

The charge-suppressing fine particles exhibit their effect when they are present in the vicinity of the toner surface. In the case of a toner produced through kneading and pulverization, the affinity between the binder resin and the charge-suppressing particles and the kneading process cause a different dispersibility. It may be possible to improve the dispersibility of the charge-suppressing particles by lowering the kneading temperature, but this can lead to severance of the binder resin. Coarse particles of the kneaded product are subjected to fine pulverization under impact, but the state of fine pulverization is random or not uniform, so that it is difficult to control the amount of the charge-suppressing fine particles on the toner surface.

In the case of toner production by suspension polymerization, a well insulating toner cannot be obtained if the colorant (particularly a magnetic material or carbon) is exposed to the surface, so that a colorant having a strong hydrophobicity is generally used. As a result, the toner particle surface becomes further insulating.

On the other hand, Japanese Laid-Open Patent Application (Kokai) No. 66857/1981 proposes the combined used of a hydrophobicity-imparted magnetic material and a non-imparted magnetic material, but it is likewise not technically easy to control the amount at the superficial part.

In the case of a microcapsule toner having a surface coated with a resinous substance, the toner particle surface is generally highly insulating. On the other hand, Japanese Laid-Open Patent Application (kokai) No. 3177/1985 proposes a microcapsule toner having a surface to which a magnetic material is substantially exposed. However, the proposed method is a coating method using a resin solution with a magnetic material dispersed therein, so that a uniform surface control is difficult in view of localization of the magnetic material.

According to the present invention, charge-suppressing particles (B) in a powdery form are fixed onto the surfaces of particles (A1) under the action of a mechanical impact, and then further coated with an outer shell. As a result, the charge-suppressing particles are integral with and move inseparably with the microcapsule toner in the subsequent steps, such as stirring for external addition of silica fine powder, stirring for development and rubbing with a carrier, etc.

In an insulating toner, it is important to regulate the triboelectric charge at a constant level. It is the control of the triboelectric charge of a toner that is important for obtaining good images under different environmental condition and for obtaining good images even in a continuous or successive image formation which are as good as those at the initial stage. Generally, if a toner is provided with a rapid triboelectric chargeability, the toner is liable to have a large triboelectric charge in terms of an absolute value, so that it becomes necessary to form a large electric field for transferring the toner particles to a surface having a latent image because of the resultant excessively large charge especially under the low-humidity condition. This results in a large load on the system and a liability of discharge due to dielectric breakdown.

On the other hand, if the magnitude of a triboelectric charge is suppressed, a long time is required to have a sufficient charge especially under the high-humidity condition, and it is impossible to prevent the toner from attaching to parts other than latent images due to some force other than an electrical force, thus leading to contamination of images.

According to the present invention, in order to solve the above problems, charge-suppressing particles are fixed onto the surfaces of particles (A1) to form particles (A2), and then shell-forming resin particles (C) are fixed onto the particles (A2), thereby to form a microcapsule toner wherein the charge-suppressing particles (B) are evenly but possibly partially disposed on the particles (A1). The triboelectric charge of the microcapsule toner according to the present invention is thus regulated. In the microcapsule toner according to the present invention, the charge-suppressing particles (B) are present in the form of being fixed onto the surfaces of the base particles (A1), and outside thereof, the shell-forming resin particles (C) are fixed to form a shell providing a coverage (i.e., areal coating rate) of preferably 51–100%, more preferably 80–100%, charging is prevented, whereas sufficient friction of microcapsule toner particles is not hindered and isolation of the charge-suppressing fine particles is prevented, so that the damage of a drum or cleaner thereby is also prevented.

If the charge-suppressing particles (B) are present on the particles (A1) in an excessive amount, the microcapsule toner is caused to have too low a resistivity and can be provided with only a small charge. Accordingly, it is preferred that the particles (B1) are used (and thus present in the microcapsule toner) in a proportion of 0.1–10 wt. parts per parts of the particles (A1). Incidentally, in the fixing steps involved in the process of the present invention, almost all the supplied particles are incorporated into the product particles (thus finally the microcapsule toner) without substantially changing quantitative ratios therebetween.

In the present invention, the particles (B) having a charge-suppressing or charge-leaking characteristic in a powdery form are fixed onto the particles (A1) under the action of a mechanical impact. As a result, the amount of the charge-suppressing particles (B) in the surface part of the microcapsule toner is directly controlled by the amount of addition of the particles (B), whereby a good developing performance is attained.

The microcapsule toner according to the present invention is characterized by presence of few isolated charge-suppressing particles so that a good developing performance is attained without causing contamination on the carrier or sleeve.

It is preferred that the charge-suppressing particles (B) are composed of charge-suppressing fine particles alone. It is possible that the particles (B) are composed of particles of a resin such as a styrene-type resin containing charge-suppressing fine particles dispersed therein. In this case, however, it is necessary to pay attention to the manner of dispersion and exposure of the fine particles.

The particles (B) may preferably have a particle size ratio of 0.2 or below with respect to the average particle size of the particles (A1). If the particle size ratio exceeds 0.2, it is difficult to uniformly fix the particles (B) onto the surfaces of the particles (A1). On the other hand, the particles (C) may preferably have a particle size ratio of 0.2 or less with respect to the average particles size of the particles (A2) comprising the particles (A1) onto which the particles (B) have been fixed. If the particles size ratio is above 0.2, it is difficult to fix the particles (C) onto the surfaces of the particles (A2).

In the present invention, the coverage by the particles (B) or the particles (C) [i.e., an areal percentage of the particles (A1) or (A2) being coated or covered by the particles (B) or (C), respectively] is given by the following equation:

$$\text{Coverage (\%)} = 1/4 \times \frac{W_2 \times R_1 \times M_1}{W_1 \times R_2 \times M_2} \times 100,$$

wherein $W_1$ denotes the weight of the particles (A1) or (A2); $W_2$, the weight of the particles (B) or (C); $R_1$, the average particle size of the particles (A1) or (A2); $R_2$ the average particle size of the particles (B) or (C); $M_1$, the true density of the particles (A1) or exceeding 100%, the coverage is determined as 100%. Coverage data described herein generally refer to calculated data based on the above equation, but the coverage can also be determined based on data obtained through microscopic observation.

As described, it is preferred that the coverage of the particles (A2) by the particles (C) is preferably 51% or more, more preferably 80% or more, particularly preferably 95% or more as calculated according to the above equation. The above equation is suitably used for determining the amounts of the starting particles. According to observation through a (scanning) electron microscope, a higher value of coverage is generally attained because of deformation or collapsing or melting of the particles (B) or (C). In the present invention, the coverage by the particles (C) obtained based on the microscopic observation (if necessary, statistically) may preferably be 80% or more, further preferably 90% or more, particularly preferably substantially 100%.

The particles (C) can cover the total surface area of the particles (A2). Even in such a case, the charge-suppressing particles are present in the vicinity of the microcapsule toner surface, so that a sufficient charge-suppressing effect is exhibited.

In the present invention, a particle size distribution is measured by the following method.

Coulter Counter Model TA-II (mfd. by Coulter Electronics Inc.) or Elzone Particle Counter Model 80 XY-2 (mfd. by Particle Data Inc., U.S.A.) is used as a measuring device and a number-basis particle size distribution and a volume-basis particle size distribution are outputted. A 1–4% aqueous NaCl solution is used as an electrolytic solution.

In the measurement, 0.1–5 ml of a surfactant, as a dispersing agent, preferably of alkylbenzenesulfonate is added to 100–150 ml of the above-mentioned aqueous electrolytic solution, and further 0.5–50 mg of a sample for measurement is added to the resultant mixture and suspended. The resultant suspension of the sample in the electrolytic solution is dispersed by means of an ultrasonic dispersing device for about 1—3 min. Thereafter, the particle size distribution of particles having a particle size of 0.2–40 microns is measured by means of the above-mentioned Coulter Counter TA-II or Elzone Particle Counter 80 XY-2 with an aperture of 12–120 microns, whereby the number-basic particle size distribution and the volume-basic particle size distribution are determined. From the distribution data, the respective average particle sizes can be obtained by calculation.

Incidentally data given herein as "particle size" without further denotation refer to value-average particle sizes.

The charge-suppressing particles (B) may, for example, comprise powder of metal alloys, metal oxides, semiconductors, ceramics, organic semiconductors and carbon showing an (electrical) resistivity of $10^{13}$–$10^{-2}$ ohm·cm, preferably $10^4-10^{-2}$ ohm·cm. These materials can be used singly or in combination of two or more species. More specific examples of the charge-suppressing particles (B) may include: powder of ferromagnetic metals such as iron, cobalt, and nickel; magnetic materials, such as magnetite, hematite, and ferrite; $SnO_2$, ZnO, $Fe_2O$, $Al_2O_3$, CaO, BaO, MgO, $TiO_2$, TiO, $SnO_2$—$TiO_2$, $SnO_2$—$BaSO_4$, $SiO_2$, $SrTiO_3$, and $TiO_2$, $Al_2O_3$ or $Al_2O_3$ can be used also for a color toner.

Figure 9:
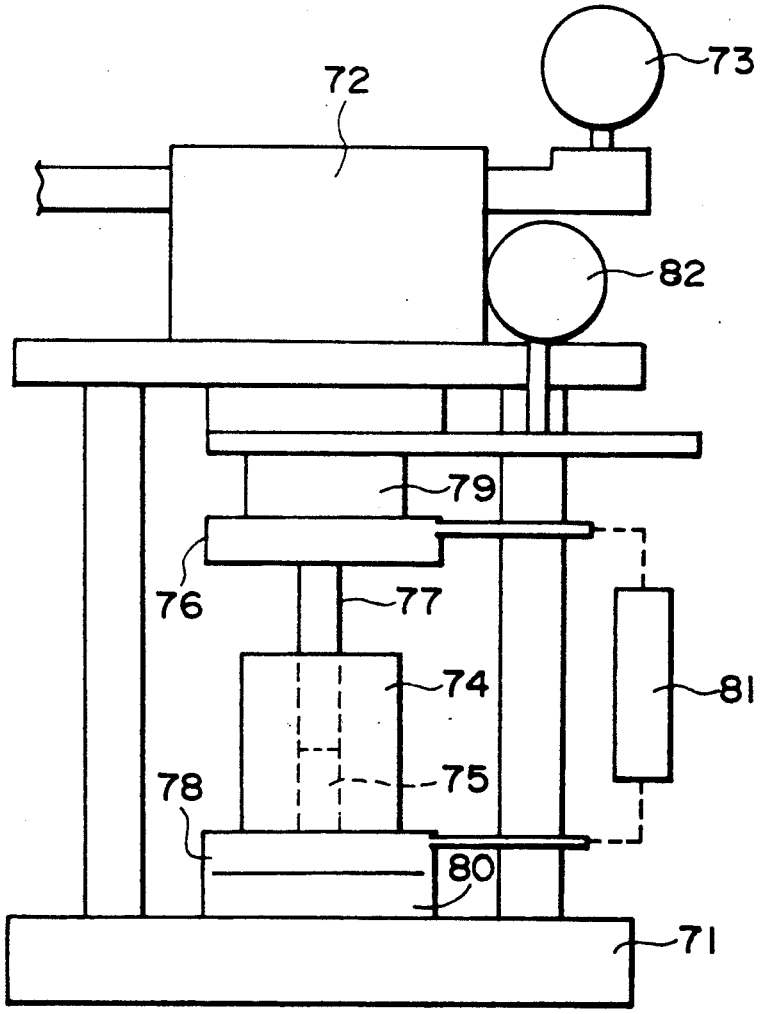
FIG. 9 is a schematic illustration of an apparatus for measuring the resistivity of charge-suppressing particles.

The resistivity of charge-suppressing particles or powder may be measured by using an apparatus as shown in FIG. 9, which comprises a base 71, a pressing means 72 equipped with a pressure gauge 73 and connected to a hand press (not shown), a 3.1 cm dia. cylindrical hard glass cell 74 in which a sample 75 is placed, a press ram 76 made of brass having a diameter of 4.266 cm and an area of 14.2856 $cm^2$, a press bar of stainless steel having a radius of 0.397 cm and an area of 0.486 $cm^2$ by which a pressure from the press ram 76 is applied to the sample 75, a bench 78 of brass, insulating plates 79, 80 of bakelite, and a resistance meter 81 connected to the members 76 and 78.

In the apparatus shown in FIG. 9, when an oil pressure of 20 $kg/cm^2$ is given by the hand press, a pressure of 576 $kg/cm^2$ is applied to the sample. The resistance at this time is read from the resistance meter 81, and the resistance value is multiplied by the sectional area of the sample and divided by the weight of the sample measured by a dial gage 82 to obtain the resistivity value of the sample.

Next, the case where the particles (B) comprise colored particles is explained.

According to the present invention, colorant particles or resin particles containing a colorant (B) and colorless resin particles (A1) are blended in powder form to form particles (A2) which comprise a colored layer fixed onto the colorless resin particles (A1), and the particles (A2) and shell-forming resin particles (C) are blended in a similar manner to form a microcapsule toner wherein the colored particles are coated with a shell formed by the particles (C).

Incidentally, in the conventional toner produced by melt-kneading, pulverization and classification, it is technically difficult to uniformly disperse such colorant in a binder resin, particularly when a crosslinked binder resin is used in order to improve the fixability of the toner. Therefore, in the prior art, it has not been easy to obtain a color toner which has wide color-reproducibility so as to provide good developing characteristics and suitable gloss as a color copied image. In the case of the toner produced through the conventional pulverization method, it is not desirable that the colorant appears on the surfaces of the pulverized particles or is isolated from the particles after pulverization of the kneaded product because it causes problems of moisture absorptivity and carrier contamination.

As the colorant used in the present invention, known pigments or dyes may be used.

Examples of the dyes may include: C.I. Direct Red 1, C.I. Direct Red 4, C.I. Acid Red 1, C.I. Basic Red 1, C.I. Mordant Red 30, C.I. Direct Blue 1, C.I. Direct Blue 2, C.I. Acid Blue 9, C.I. Acid Blue 15, C.I. Basic Blue 3, C.I. Basic Blue 5, and C.I. Mordant Blue 7.

Examples of the pigments may include: carbon black Naphthol Yellow S, Hansa Yellow G, Permanent Yellow NCG, Permanent Orange GTR, Pyrazolone Orange, Benzidine Orange G, Permanent Red 4R, Watching Red calcium salt, Brilliant Carmine 3B, Fast Violet B, Methyl Violet Lake, Phthalocyanine Blue, Fast Sky Blue, and Indanthrene Blue BC.

Particularly preferred pigments may include disazo yellow pigments, insoluble azo pigments and copper phthalocyanine pigments, and particularly preferred dyes may include basic dyes and oil-soluble dyes.

Particularly preferred examples may include: C.I. Pigment Yellow 17, C.I. Pigment Yellow 15, C.I. Pigment Yellow 13, C.I. Pigment Yellow 14, C.I. Pigment Yellow 12, C.I. Pigment Red 5, C.I. Pigment Red 3, C.I. Pigment Red 2, C.I. Pigment Red 6, C.I. Pigment Red 7, C.I. Pigment Blue 15, C.I. Pigment Blue 16, copper phthalocyanine pigments having two to three carboxybenzamidomethyl groups, and copper phthalocyanine pigments such as one represented by the following formula (I), which has a phthalocyanine skeleton to which 2-3 carboxybenzamidomethyl group in the form of Ba salts are attached:

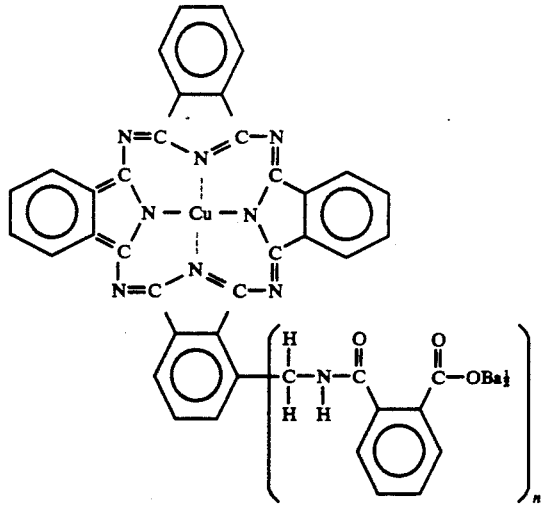

n = 2-3

Particularly preferred examples of dyes may include: C.I. Solvent Red 49, C.I. Solvent Red 52, C.I. Solvent Red 109, C.I. Basic Red 12, C.I. Basic Red 1 and C.I. Basic Red 3B.

In the case where the colored particles (B) comprise resin particles containing a colorant, the colorant particles (B) are fixed onto the particles (A1) and then coated with the shell-forming resin particles (C) in the present invention. Accordingly, it is possible to select the resin for constituting the colored particles (B) by only considering the ability of dispersing the colorant and without considering the chargeability. Further, in case of producing the colored particles (B) by suspension polymerization, it is possible to select a polymer system not causing polymerization inhibition or poor dispersibility without paying attention to the chargeability of the resin particles formed thereby, so that a broad latitude is allowed for selection of the monomer system.

In such colored particles (B), it is preferred that the colorant and the resin are used in a ratio of 1:99-99:1, more preferably 5:95-95:5.

The coverage by the particles (B) may be arbitrarily selected according to a required coloring ability because of the capsule structure of the toner according to the invention. It is generally required that a colorant is contained in a proportion of 1 wt. % or more in the microcapsule toner in view of an ordinary coloring ability of a colorant. Accordingly, the coverage should preferably be 1-100% by conversion.

Next, the case where the particles (B) comprise charge-controlling (or charge-enhancing) particles is explained.

The coverage of the base particles (A1) with the charge-controlling particles (B2) may preferably be 0.1-50%. More specifically, in the case where the particles (B) substantially composed of a charge controller per se, the coverage may preferably be 0.1-10%, more preferably 0.2-5%. In the case where the particles (B) comprises a charge controller and resinous component, the coverage may preferably be 0.2-50%, more preferably 0.4-40%.

If the coverage by the charge-controlling particles (B) is below 0.1%, the charge-controlling property may be insufficient. On the other hand, if the coverage is above 50%, the absolute triboelectric charge of the toner may excessively be increased whereby the image density of a toner image tends to be lowered.

The charge-controlling particles (B) may preferably be used in a proportion of 0.1–5 wt. parts per 100 wt. parts of the particles (A1).

As briefly mentioned hereinabove, the charge-controlling particles (B) can either be composed of particles of a charge controller alone or resin particles in which a charge controller is dispersed.

The charge controller usable in the present invention refers to a substance having the following triboelectrical charging characteristic.

100 wt. parts of a bulk-polymerized product of a polystyrene resin (weight-average molecular weight: about 100,000–200,000) and 5 wt. parts of a charge controller are sufficiently melt-kneaded (e.g., for about 30 min.–1 hour) by means of a hot roller at a temperature of 100°–150° C., and then cooled, pulverized, and classified thereby to prepare polystyrene particles having a mode particle size of 10 microns and containing the charge controller.

About 5 g of the thus prepared polystyrene particles and 95 g of carrier iron powder having a mode particle size of 200–300 mesh, which is not covered with a resin (e.g., EFV 200/300, mfd. by Nihon Teppun K.K.) are left standing overnight under conditions of 25° C. and 50–60%RH. Thereafter, the polystyrene particles are the iron powder and sufficiently mixed (for about 5–10 min.) in a polyethylene container having a volume of about 200 cc, and the triboelectric charge of the charge controller is measured by using an aluminum cell with a 400 mesh-screen according to an ordinary blow-off method. The charge controller usable in the present invention is one having the thus measured triboelectric charge of 3 μC/g or more, particularly 7 C/g or more, in terms of the absolute value thereof.

Further, the charge-controlling particles (B) may preferably have a triboelectric chargeability such that the absolute amount of the triboelectric charge measured by the above-mentioned blow-off method is 3 μC/g or above.

As the charge controller to be used in the microcapsule toner of the present invention, positive or negative charge controllers which are solid at least in a temperature range of 20°–90° C. can be used. Examples of charge controllers used in the present invention may include those as set forth below.

(1) As the controller which controls the toner to be positively chargeable, the following substances may be included:

Nigrosine; azine dyes having an alkyl group containing 2–16 carbon atoms (as disclosed in Japanese Patent Publication (JP-B, Kokoku) No. 1627/1967); basic dyes including, e.g., C.I. Basic Yellow 2 (C.I. 41000), C.I. Basic Yellow 3, C.I. Basic Red 1 (C.I. 45160), C.I. Basic Red 9 (C.I. 42500), C.I. Basic Violet 1 (C.I. 42535), C.I. Basic Violet 3 (C.I. 42555), C.I. Basic Violet 10 (C.I. 45170), C.I. Basic Violet 14 (C.I. 42510), C.I. Basic Blue 1 (C.I. 42025), C.I. Basic Blue 3 (C.I. 51005), C.I. Basic Blue 5 (C.I. 42140), C.I. Basic Blue 7 (C.I. 42595), C.I. Basic Blue 9 (C.I. 52015), C.I. Basic Blue 24 (C.I. 52030), C.I. Basic Blue 25 (C.I. 52025), C.I. Basic Blue 26 (C.I. 44045), C.I. Basic Green 1 (C.I. 42020), C.I. Basic Green 4 (C.I. 42000); lake pigments of these basic dyes (lake-forming agent may be phosphotungstic acid, phosphomolybdic acid, phosphotungustomolybdic acid, tannic acid, lauric acid, gallic acid, ferricyanide, ferrocyanide); C.I. Solvent Black 3 (C.I. 26150), Hansa Yellow G (C.I. 11680), C.I. Mordant Black 11, C.I. Pigment Black 1, benzylmethyl-hexadecylammonium chloride and decyltrimethylammonium chloride; dialkyltin compounds having groups such as dibutyl and dioctyl; dialkyltin borate compounds; guanidine derivatives; vinyl polymers having an amino group; polyamine resins such as condensation-polymerized polymer having an amino group.

(2) As the controller which controls a toner to be negatively chargeable, the following substances may be included:

metal complex compounds of monoazo dyes as disclosed in Japanese Patent Publication (KOKOKU) Nos. 20153/1966, 27596/1968, 6397/1969, 26478/1970;

metal complex compounds containing a Zn, Al, Co, Cr or Fe atom and salicylic acid, dialkylsalicylic acid, naphthoic acid or dicarboxylic acids as disclosed in Japanese Patent Publication (KOKOKU) Nos. 42752/1980, 41508/1983, 7384/1983 and 7385/1984; and sulfonated copper phthalocyanine pigments.

Further, it is preferred that the charge controller used in the present invention has characteristics of little environmental dependence, thermal stability, mechanical stability and chemical stability.

If the charge controller is resinous, it is pulverized in an ordinary method to obtain fine particles, which may be classified as desired so as to provide a better particle size distribution. Fine particles may also be obtained by spraying under heating.

The charge-controlling particles (B) may preferably be used in a proportion of 0.01–10 wt. parts, particularly 0.05–2 wt. parts, per 100 wt. parts of the particles (A1).

Next, the case where the particles (B) comprise abrasive particles is explained.

In the microcapsule toner according to the present invention, abrasive particles (B) are half embedded in the surfaces of particles (A1) to be firmly and partially or sparsely fixed by the particles (A1), so that the abrasive function of the microcapsule toner per se is controlled without adversely affecting the developing performance, transfer performance, fixing performance and anti-offset characteristic, of the microcapsule toner, whereby undesirable phenomena such as image flow and melt sticking are prevented. As a result, the life of the photosensitive member in elongated, and the designing of a microcapsule toner and also a copying machine is facilitated.

In the present invention, the abrasive particles (B) in a powdery form are fixed onto the particles (A1) under the action of a mechanical impact. As a result, the abrasive particles (B) are made integral with the microcapsule toner and move together with the toner without isolation in subsequent steps.

Further, the amount of the abrasive particles present at the superficial part of the particles (A1) is controlled by the amount of addition thereof, and the state of the presence is uniform, so that the excellent abrasive function of the particles (B) are utilized as is and the abrasive characteristic of the microcapsule toner can be widely controlled by changing the kind and amount of the abrasive particles.

The abrasive particles fixed onto the surfaces of the particles (A1) may exhibit an effect in a small amount and are not isolated from the microcapsule toner during development, so that the effect of the abrasive can be attained without adversely affecting the chargeability and fluidity of the microcapsule toner.

It is preferred that the abrasive particles (B) are composed of abrasive particles alone. It is possible that the particles (B) are composed of particles of a resin such as polystyrene containing abrasive fine particles therein. In this case, however, it is necessary to pay attention to the manner of dispersion and exposure of the fine particles.

The abrasive particles (B) used in the present invention may comprise one or more species of inorganic metal oxides, nitrides, carbides, sulfates and carbonates having a Mohs hardness of 3 or higher. Specific examples thereof may include: metal oxides, such as $SiO_2$, $SrTiO_3$, $CeO_2$, CrO, $Al_2O_3$ and MgO; nitrides such as $Si_3N_4$; carbides, such as SiC; and metal sulfates or carbonates, such as $CaSO_4$, $BaSO_4$ and $CaCO_3$. Preferred examples thereof may include: inorganic material having a Mohs hardness of 5 or higher, such as $SiO_2$, $SrTiO_3$, $CeO_2$ (including powder comprising $CeO_2$ and a rare earth element, such as Mirek, Mirek T and ROX M-1), $Si_3N$ and SiC.

The coverage of the particles (A1) by the abrasive particles (B) is preferably 10–100%. The abrasive particles (B) may preferably be used in a proportion of 0.1–30 wt. parts per 100 wt. parts of the particles (A1).

The microcapsule toner obtained by fixing the abrasive particles (B) may preferably be combined with lubricative fine powder such as that of fatty acid metal salts and PVdF (polyvinylidene fluoride) externally added thereto in order to facilitating the cleaning or removal of a low-resistivity substance such as a toner or paper dust.

Examples of such lubricative fine powder may include fine powder of: fluorinated polymer substance, such as polytetrafluoroethylene, polyvinylidene fluoride and fluorinated carbon; and fatty acid metal salts, such as zinc stearate, calcium stearate, magnesium stearate, zinc oleate, zinc palmitate, and magnesium palmitate.

It is preferred that such lubricative fine powder has an average particle size of 6 microns or smaller, more preferably 5 microns or smaller. The lubricative fine powder may preferably be externally added in a proportion of 0.5 wt. % or less, particularly 0.01–0.3 wt. % of the microcapsule toner.

Next, the case where the particles (B) comprise releasing particles is explained.

In a conventional toner obtained through kneading and pulverization, the release agent and the binder resin generally have a poor compatibility with each other, so that the release agent is liable to be nonuniformly present in the toner particles and it is difficult to control the content thereof at the surface part. Sometimes, the release agent is isolated from the binder resin to contaminate the carrier and sleeve and deteriorate the developing performance of the developer.

The isolated release agent is commingled in a large proportion into fine powder after classification and the fine powder is recovered by a cyclone. The fine powder, if reutilized, causes a composition change leading to a charge in toner performances.

In the microcapsule toner of the present invention, releasing particles (B) in the form of powder are fixed onto the surfaces of the particles (A1) under the action of a mechanical impact, and then shell-forming resin particles are fixed thereto under the action of a mechanical impact. Accordingly, in the microcapsule toner of the present invention, the releasing particles (B) are not isolated from the toner but are integral with the toner to move together in the subsequent steps.

The amount of the release agent at the surface of the particles (A1) is readily controlled, are the release agent can be uniformly present on the surface. As a result, the release agent at the surface of the particles (A1) is uniformly and effectively melted under heating and pressure to provide a good anti-offset characteristic. Further, the microcapsule toner obtained in this manner is substantially free from isolation of the release agent, so that carrier contamination or sleeve contamination is prevented to provide good developing performance.

A release agent generally tends to suppress the absolute charge, and some time is required for a toner to have a sufficient charge. As a result, it becomes difficult to prevent the toner from attaching to parts other than latent image parts due to some forces other than electrical force, thus resulting in contamination of images. This problem can be solved by having the releasing particles (B) be fixed partially or locally onto the surfaces of colorless or colored particles (A1) to form particles (A2), and then electrically insulating shell-forming resin particles (C) are fixed onto the particles (A2) to form a coating.

On the other hand, if the release agent is present on the entire surfaces of the particles (A1), it is presumed difficult to prevent such an adverse effect to the chargeability.

The releasing particles (B) may be a release agent per se or resin particles containing a release agent dispersed therein.

The particles (A2) obtained by using the releasing particles (B) may preferably be coated with the shell-forming resin particles (C) at a coverage of 51% or higher. Even if the coverage is 100%, the releasing function is sufficiently exhibited as the releasing particles (B) are present in the vicinity of the surface.

Examples of the release agent may include those as described below, but are not restricted thereto. The release agent may preferably be a low-molecular weight resin or wax having a softening point measured by the ring and ball method (as described in JIS K 2531) of 40°–130° C., more preferably 50°–120 ° C. If the softening point is below 40° C., the antiblocking property and the shape-retaining property of the toner may be insufficient. On the other hand, if the softening point is above 130° C., the effect in reducing a fixing temperature or a fixing pressure is small.

Examples of the release agent include paraffin waxes, low-molecular weight polyolefins, modified waxes having an aromatic group, hydrocarbon compounds having an alicyclic group, natural waxes, long-chain carboxylic acids having a long hydrocarbon chain ($CH_3$-$(CH_2)_{11}$ or $(CH_2)_{12}$ or a longer aliphatic chain) including 12 or more carbon atoms, esters and metal salts thereof, fatty acid amides and fatty acid bisamides. A mixture of different release agents can be used.

More specifically, examples of commercially available products include Paraffin Wax (Nihon Sekiyu K.K.), Paraffin Wax (Nihon Seiro K.K.), Microwax (Nihon Sekiyu K.K.), Microcrystalline Wax (Nihon Seiro K.K.), PE-130 (Hoechst), Mitsui Hi-Wax 110P (Mitsui Sekiyu Kagaku K.K.), Mitsui Hi-Wax 220P (ditto), Mitsui Hi-Wax 660P (ditto), Mitsui Hi-Wax 210P (ditto), Mitsui Hi-Wax 320P (ditto), Mitsui Hi-Wax 410P (ditto), Mitsui Hi-Wax 420P (ditto), Modified Wax JC-1141 (ditto), Modified Wax JC-2130 (ditto), Modified Wax JC-4020 (ditto), Modified Wax JC-1142

(ditto), Modified Wax JC-5020 (ditto); bees wax, carnauba wax, montan wax, and polytetrafluoroethylene.

On the other hand, examples of the fatty acid metal salt may include: zinc stearate, calcium stearate, magnesium stearate, zinc oleate, zinc palmitate, and magnesium palmitate.

These release agents may be used singly or in combination of two or more species.

The release agent may constitute the releasing particles (B) by itself or in a dispersed form in resin particles.

It is preferred that the releasing particles (B) are used in a proportion of 0.1–5 wt. parts per 100 wt. parts of the particles (A1).

It is possible that the above-described charge-suppressing agent, colorant, charge controller, abrasive agent and/or release agent functioning as an active component of the particles (B) constitutes the particles (B) through mixing with a resin and granulation. It is also possible to disperse such an active component in a monomer composition, and subjecting the dispersion to suspension polymerization to form the particles (B). Such resinous components may be selected from binder resins for the particles (A1) described hereinafter.

Hereinbelow, the process for producing a microcapsule toner according to the present invention will be explained more specifically.

According to a preferred embodiment, the process of the present invention may be sub-divided into at least four steps as follows:

a pretreatment step for dispersing and uniformly attaching particles (B) onto particles (A1);

a step of fixing the attached particles (B) onto the surfaces of the particles (A1) under the action of an impact to form particles (A2);

a pretreatment step for dispersing and uniformly attaching particles (C) onto the particles (A2); and a step of fixing the attached particles (C) onto the surfaces of the particles (A2) under the action of an impact.

In the pretreatment step, the particles (B) or (C), while being dispersed, are subjected to friction with particles (A1) or (A2), respectively, whereby the particles (B) or (C) are attached to the particles (A1) or (A2) under the action of an electrostatic force (and a Van der Waals force). In this step, a mixer having a stirring vane rotatable at a high speed may generally be used, but a mixer used in this step is not restricted thereto. More specifically, another mixer may be used as far as it has a mixing function and a dispersing function.

Figure 1:
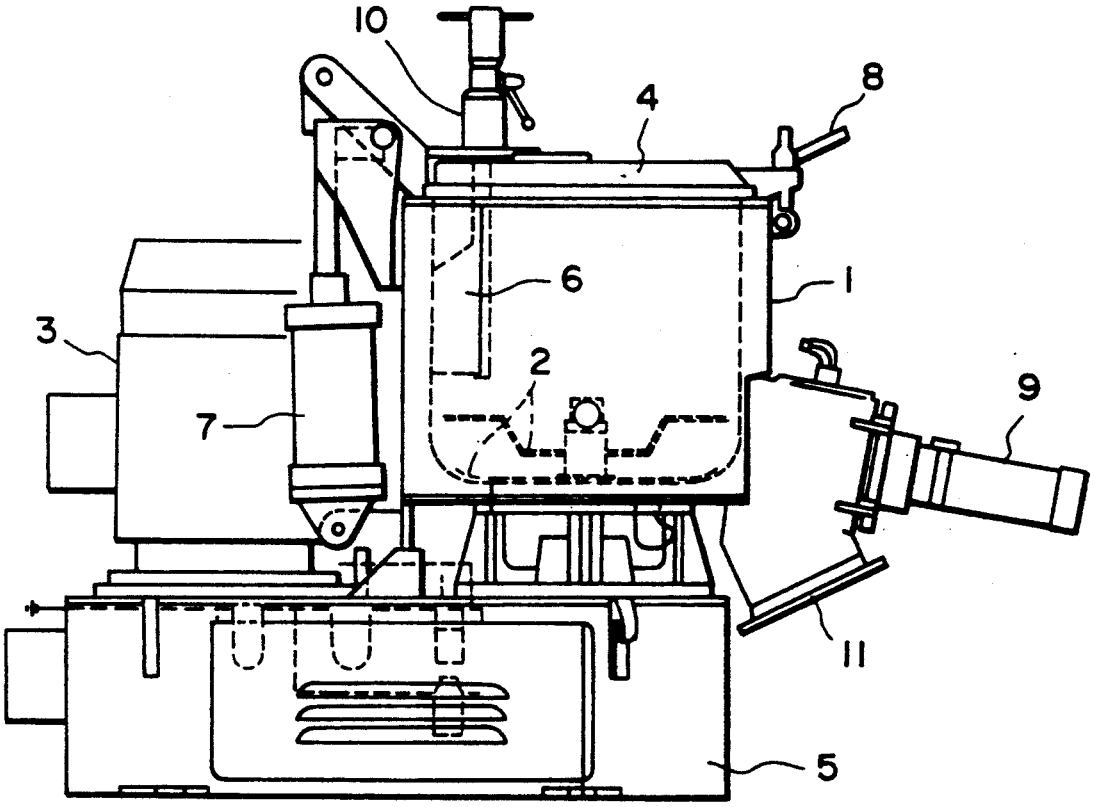
FIG. 1 is a schematic sectional view showing an embodiment of a stirring device for pretreating base particles (A1) and modifier particles (B), or for pretreating particles (A2) and particles (C)

FIG. 1 shows an embodiment of a mixer (Henschel mixer) having a high-speed stirring vane, which is used in the pretreatment. The mixer shown in FIG. 1 comprises a jacket 1, a stirring vane 2, a motor 3 for driving the stirring vane, a lid 4, a base 5, a control plate 6 for collision with powder, a cylinder 7 for lifting the lid, a locking device for the lid, a cylinder 9, a direction control unit 10 for changing the angle of the control plate, and a discharge port 11.

In the pretreatment, it is required that the particles are sufficiently dispersed, and the particles are not substantially pulverized. In the pretreatment, in consideration of the physical properties of a material for toner, the following conditions may preferably be used: a process temperature (ambient temperature) of 0°–50° C., a peripheral speed at the tip of a stirring vane of 5–50 m/sec; a process time of 1–60 min, preferably 1–20 min; the length of a stirring vane of 10–100 cm, which is preferable in view of mixing efficiency and the prevention of the pulverization. Further, in this treatment, the treatment chamber may preferably be cooled by means of a jacket or cooling air, because the stirring may elevate the temperature.

As the device for the pretreatment, in addition to the above-mentioned mixer having a high-speed stirring vane, there may be used a device which has a dispersing and a mixing functions and can provide a sufficiently long residence time. More specifically, there may be used a machine such as a pulverizer or a vibration mill, while reducing the impact force thereof so as to satisfy the above-mentioned conditions.

In the above-mentioned pretreatment wherein the particles (B) (or (C)) are uniformly attached to the particles (A1 (or A2)), the fluidity or flowability and the dispersibility of the modifier particles (B) are important. If the particles (B) (or (C)) are strongly aggregated, they cannot be reformed into the individual particles in the pretreatment step, whereby the uniform attachment of the particles (B) (or (C)) to the particles (A1) (or A2)) tends to be difficult. Similarly, if the fluidity of the particles (B) (or (C)) is extremely poor, they cannot be formed into the individual particles in the pretreatment step, whereby the uniform attachment of the particles (B) or (C)) to the particles (A1) (or A2)) tends to be difficult. In the case of the particles (B) (or (C)) having a relatively poor fluidity and dispersibility, it is particularly preferred that silica fine powder is added to the particles (B) (or (C)) and mixed therewith in advance thereby to improve the fluidity and dispersibility thereof, and then the resultant particles (B) (or (C)) are uniformly attached to the particles (A1) (or (A2)).

In this instance, there may preferably be used positive chargeability-imparted silica for providing a positively chargeable toner. On the other hand, there may preferably be used negative chargeability-imparted silica for providing a negatively chargeable toner.

The silica powder may preferably be added to the particles (B) (or (C)) in an amount of 0.01–10 wt %, more preferably 0.1–5 wt. %, based on the weight of the particles (B) (or (C)). As such treated silica, there may preferably be used hydrophobic silica fine powder which has been treated with one or more species of a positive or negative chargeability-imparting silane coupling agent, or a silicone oil.

The fine silica powder used in this embodiment may preferably have a specific surface area measured by the nitrogen adsorption method of 40–400 $m^2/g$. Further, the fine silica powder should preferably exhibit a hydrophobicity of 30–80 as measured by the methanol titration test in view of environmental stability of the resultant toner.

The "methanol titration test" defined herein for the evaluation of hydrophobicity of treated fine silica powder is conducted as follows.

Sample fine silica powder (0.2 g) is charged into 50 ml of water in 250 ml-Erlenmeyer's flask. Methanol is added dropwise from a buret until the whole amount of the silica is wetted therewith. During this operation, the content in the flask is constantly stirred by means of a magnetic stirrer. The end point can be observed when the total amount of the fine silica particles is suspended in the liquid, and the hydrophobicity is represented by the percentage of the methanol in the liquid mixture of water and methanol on reaching the end point.

Then, a method of fixing will be described.

During the fixation step, it is not preferred that the fragment of the particles (A1) or (A2) or the particles (B) or (C) are isolated or that the particles (B) or (C) once attached to the particles (A1) or (A2) are again separated therefrom. Therefore, it is preferred that the particles (B) or (C) are more securely fixed to the base particles (A1) or (A2). Further, in this step, it is important to control the impact force so that the particles (A1) or (A2) are not substantially pulverized, and to control the temperature so that fusion or agglomeration thereof does not occur.

Figure 2A:
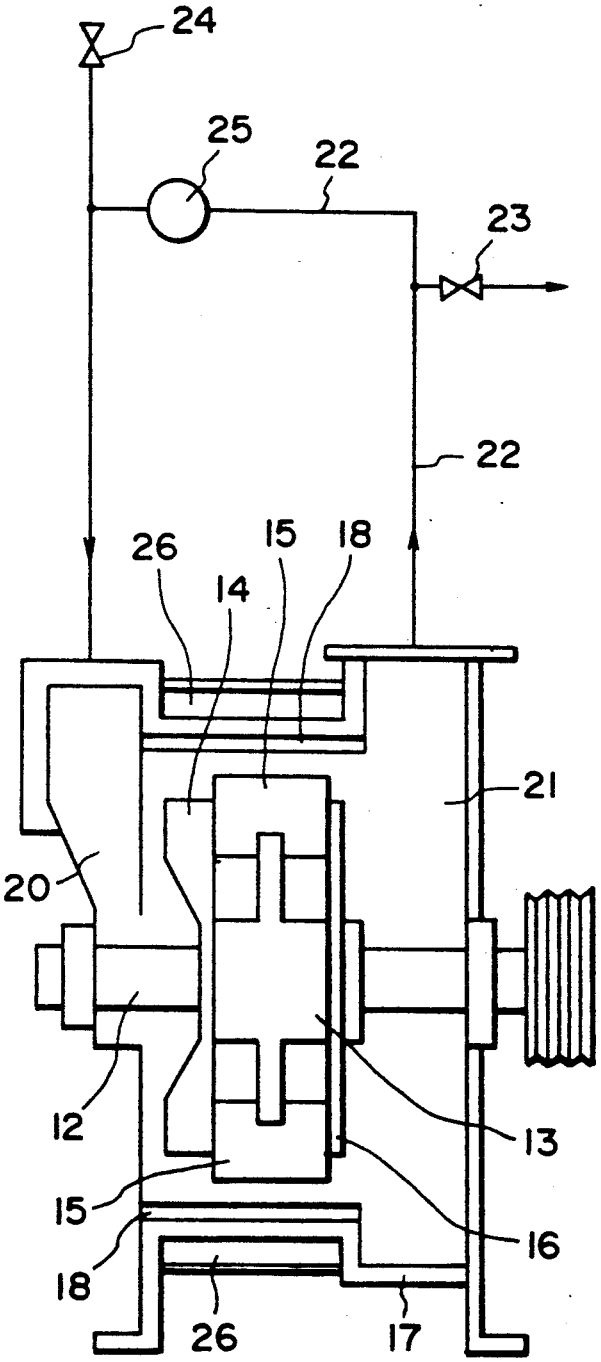
FIG. 2A is a schematic sectional view showing an embodiment of a device for fixing the modifier particles (B) to the base particles (A1) or for fixing the particles (C) to the particles (A2)
Figure 3A:
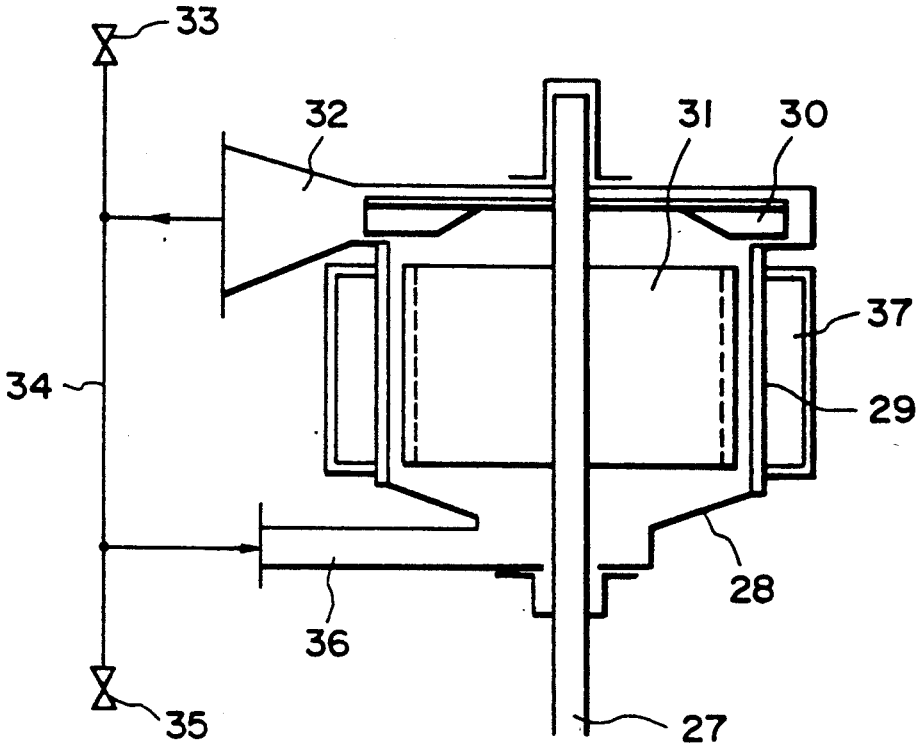
FIG. 3A is a schematic sectional view showing another embodiment of a device for fixing the modifier particles (B) to the base particles (A1) or for fixing the particles (C) to the particles (A2)
Figure 4A:
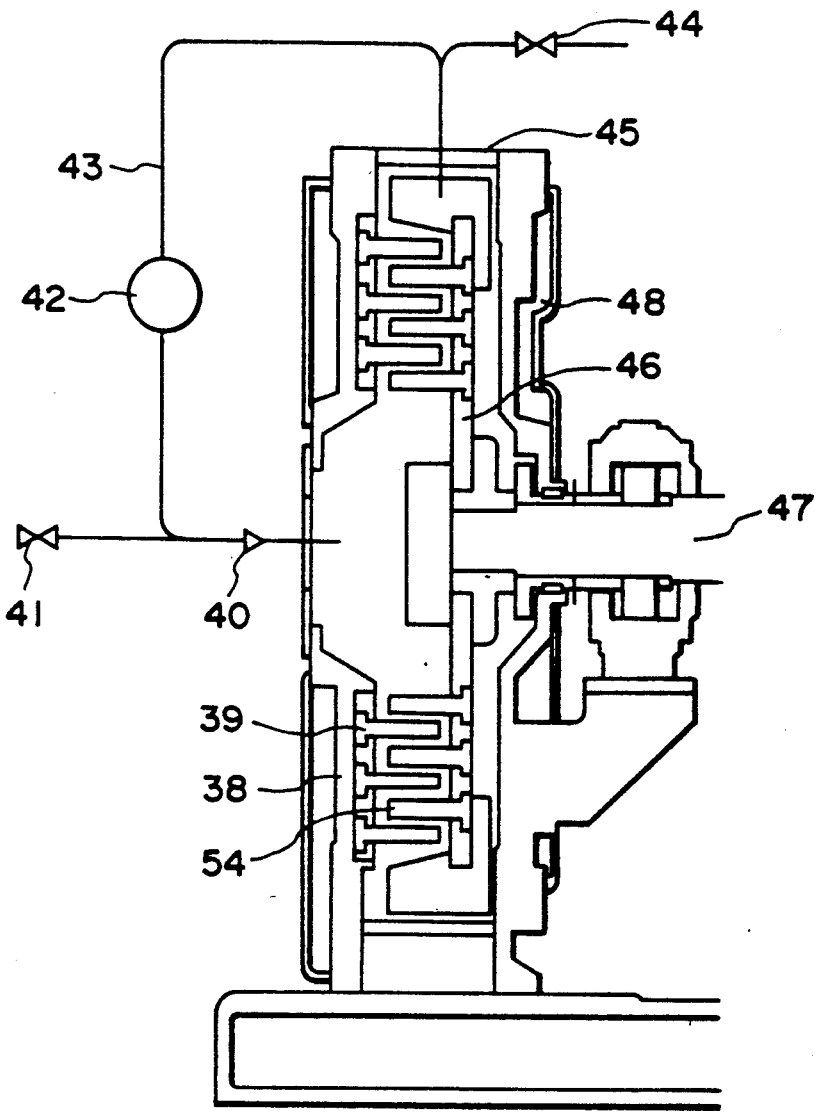
FIG. 4A is a schematic sectional view showing an embodiment of a pin mill-type device for fixing the modifier particles (B) to the base particles (A1) or for fixing the particles (C) to the particles (A2)

For example, there may effectively be used; a pin mill as shown in FIG. 4A which has a recycling function and has a large number of rotating pins; or a pulverizer as shown in FIG. 2A or 3A which has a recycling mechanism and wherein an impact force is provided between a liner (fixed member) and a rotating blade or hammer (rotating member).

The fixing step may preferably be conducted at a peripheral speed of 30–150 m/sec, more preferably 30–130 m/sec, at the tip of the blade or hammer. The process or ambient temperature in a treatment chamber (gaseous phase) in the fixing step may preferably be 20°–100° C., more preferably 20°–90° C., further preferably 30°–70° C. while it varies depending on the physical property of the particles (A1) or (A2) and the particles (B) or (C). Further, the ambient temperature may preferably be at least 20° C. lower than the softening point of the base particles (A). Further, the total residence time of the particles in an impact zone (i.e., the portion in which the impact force is applied thereto) may preferably be 0.02–12 sec. The particles may be recycled so as to pass through the impact zone a plurality of times.

In a case where the pin mill is used, it is generally required to increase the powder density. However, in the type of a machine as shown in FIG. 2A or 3A, more latitude in the density may be allowed because the powder to be treated is gathered into the vicinity of the liner under the action of a centrifugal force.

Figure 2B:
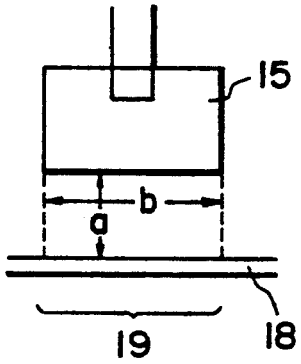
FIG. 2B is an enlarged schematic sectional view showing a part of the device shown in FIG. 2A.

The device shown in FIGS. 2A and 2B comprises a rotation axis 12, a rotor 13, a dispersing vane 14, a rotating member (blade) 15, a partition circular plate 16, a casing 17, a liner (fixed member) 18, an impact zone 19 (FIG. 2B), an inlet chamber 20, an outlet chamber 21, a return conduit 22, an outlet valve 23 for a product, an intake valve 24 for a feed material, a blower 25, and a jacket 26.

The minimum clearance between the pins of the pin mill or the clearance between the liner and the blade or hammer may preferably be about 0.5–5 mm, more preferably 1–3 mm in order to obtain more desirable results of fixing.

More specifically, referring to FIG. 2A, the particles (A1) and (B) or the particles (A2) and (C) pretreated in the above-mentioned manner are supplied through the inlet 24, passed through the inlet chamber 20, and then passed through the impact zone 19 between the liner 18 and the blade 15 which rotates along the rotating dispersing vane 14. Thereafter, these particles are passed through the outlet chamber 21, the return conduit 22 and the blower 25, and again recycled in such circuit. After the completion of the fixing treatment, the coated product is discharged through the outlet 23 for a product.

In this treatment, the powder comprising the particles (A1) and (B) or particles (A2) and (C) is supplied with an impact force in the impact zone 19 surrounded by the blade 15 and the liner 18, whereby the particles (B) or (C) are fixed onto the particles (A1) or (A2). It is preferred to control the temperature by supplying cooling water to the jacket 26.

In FIG. 2B, the clearance a between the rotating member (blade) 15 and the liner 18 is a minimum clearance, and the space corresponding to the width b of the rotating blade 15 is the impact zone. The width b may preferably be 10–1,000 mm. Further, the distance from the tip of a blade 15 on one side to that of the blade 15 on the opposite side (i.e., the distance from the tip of the upper blade 15 to that of the lower blade 15, as shown in FIG. 2A) may preferably be 100–1,000 mm in view of fixing efficiency.

Figure 3B:
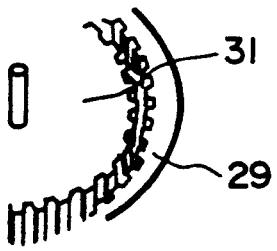
FIGS. 3B and 3C are enlarged schematic views each showing a part of the device shown in FIG. 3A.
Figure 3C:
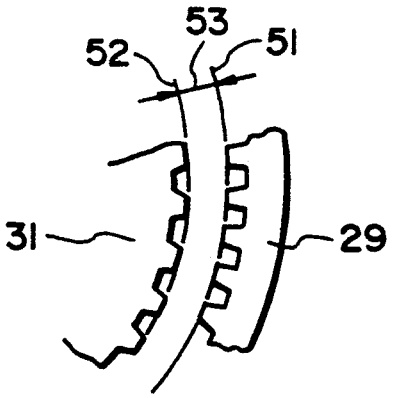

On the other hand, a device for fixing treatment as shown in FIGS. 3A, 3B and 3C comprises a rotation axis 27, a casing 28, a liner 29, a blower vane 30, a rotor 31 having a blade, an outlet port 32, a feed material supply port 33, a return conduit 34, an outlet 35 for a product, an inlet port 36, and a jacket 37.

FIG. 3C shows a positional relationship between the liner 29 and the rotating rotor 31 in the fixing device shown in FIG. 3A. The minimum clearance 53 between the liner 29 and the rotor 31 is the difference in radius between two kinds of circles, i.e., a circle 51 obtained by connecting the tip points of the protrusions of the liner 29 protruding toward the inside of the device; and a circle 52 traced by the point on the periphery of the protrusion of the rotor 31. This minimum clearance 53 may be determined in the same manner as described above, in a case where a blade or a hammer is used instead of the rotor 31.

Figure 4B:
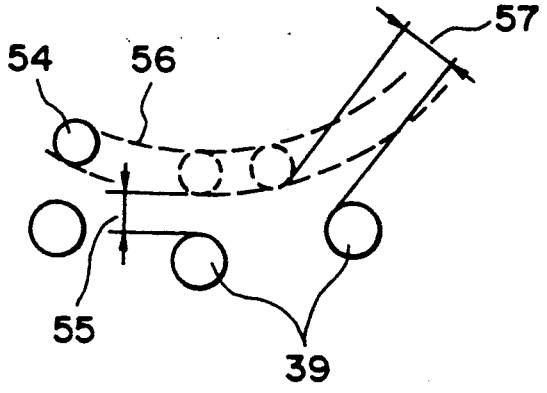
FIG. 4B is an enlarged schematic sectional view showing a part of the device shown in FIG. 4A.

Further, a pin mill-type device for fixing treatment as shown in FIGS. 4A and 4B comprises a casing 38, a fixed pin 39, an inlet port 40, a feed material supply port 41, a recycling blower 42, a return conduit 43, an outlet 44 for a product, an outlet port 45, a rotor 46, a rotation axis 47, a jacket 48, and a rotating pin 54.

FIG. 4B shows a schematic view of the pins in the pin mill-type fixing device as viewed from the front direction of the device. In FIG. 4B, the clearance 55 between the fixed pin 39 and the rotating pin 54 is a minimum clearance. Incidentally, reference numeral 57 denotes a maximum clearance between the fixed pin 39 and the rotating pin 54, and numeral 56 denotes a circle traced by the rotating pin 54. In case of the pin mill, a preferred result may be obtained by adjusting the minimum clearance between the pins to 0.5–5 mm and adjusting the maximum clearance to 10 mm or below, more preferably 5 mm or below.

In the above-mentioned FIGS. 2B, 3C and 4B, an impact force is applied to a mixture of the particles (A1) and (B) or a mixture of the particles (A2) and (C) between a moving member (such as a rotating member) and a fixed member. In the present invention, such impact force may also be applied to the mixture between at least two moving members such as rotating members.

Now, explanation is given to the particles (A1) and (C).

The particles (A1) may be either colorless resinous particles or colored resinous particles.

The colored resinous particles (A1) may for example be prepared in the following manner.

A composition comprising at least a binder resin (and a release agent, as desired) is melt-kneaded, cooled, and pulverized by means of a pulverizer thereby to prepare base particles (A1). The thus prepared base particles (A1) may be classified to adjust the particle size thereof, as desired. In order to obtain a microcapsule toner for development, the volume-average particle size of the base particles (A1) may preferably be 2–20 microns.

The binder resin for toner to be used in the base particles (A1) may include: homopolymers of styrene and substituted derivatives thereof such as polystyrene; styrene copolymers such as styrene-acrylic acid ester copolymer, styrene-methacrylic acid ester copolymer, styrene-acrylonitrile copolymer, styrene-butadiene copolymer, styrene-isoprene copolymer, and styrene-acrylonitrile-indene copolymer; acrylic resins, methacrylic resins, silicone resins, polyester resins, epoxy resins, etc. In the present invention, there may preferably be used a crosslinked styrene copolymer or crosslinked polyester for providing a microcapsule toner to be used in a hot roller fixing system. Examples of comonomers to be copolymerized in the above-mentioned styrene copolymer include: monocarboxylic acids having a double bond or derivatives thereof such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, and acrylamide; dicarboxylic acids having a double bond or derivatives thereof such as maleic acid, butyl maleate, methyl maleate, and dimethyl maleate. These vinyl monomers may be used singly or as a mixture of two or more species.

Further, the crosslinking agent may generally comprise a compound having two or more polymerizable double bonds. Examples of such crosslinking agent may include: aromatic divinyl compounds such as divinylbenzene and divinylnaphthalene, carboxylic acid esters having two double bonds such as ethylene glycol diacrylate, ethylene glycol dimethacrylate, and 1,3-butanediol dimethacrylate; divinyl compounds such as divinylaniline, divinyl ether, divinyl sulfide and divinyl sulfone; and compounds having 3 or more vinyl groups. These compounds may be used singly or as a mixture. The crosslinking agent may preferably be used in a proportion of 0.1–5 wt. parts per 100 wt. parts of the polymerizable monomer mixed therewith.

Next, some explanation is added to magnetic particles or colorant which may be used in the particles (A1). In order to produce a magnetic toner, magnetic particles are added thereto. In this case, the magnetic particles also function as a colorant. The magnetic particles usable in the present invention may be a substance magnetizable when placed in a magnetic field, such as powder of a ferromagnetic metal such as iron, cobalt and nickel, or an alloy or compound thereof such as magnetite, hematite and ferrite. The magnetic particles may generally have a particle size of preferably 0.1–1 micron, more preferably 0.1–0.5 micron. The content of the magnetic particles may suitably be 10–65 wt. %, preferably 10–60 wt. % based on the weight of the microcapsule toner. It is possible that the magnetic particles have been treated with a treating agent such as silane coupling agent or titanate coupling agent or with an appropriate reactive resin. In this case, while also depending on the surface area of the magnetic particles or the density of the hydroxyl group present at the surface thereof, a treating amount of 5 wt. % or less, preferably 0.1–3 wt. %, may provide a sufficient dispersibility.

The colorant may be selected from those colorants described above in relation to the particles (B). The colorant may preferably be added in a proportion of 0.5 to 30 wt. % based on the binder resin.

It is particularly preferred to obtain the base particles (A1) through suspension polymerization as described below, because the resultant base particle (A1) may have a spherical shape and a sharp particle size distribution.

In a case where the base particles (A) are prepared through suspension polymerization, the polymerizable monomer applicable to the present invention may be those having a vinyl group

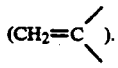

Examples thereof include: styrene, styrene derivatives such as o-methylstyrene, m-methylstyrene, p-methylstyrene, p-methoxystyrene, and p-ethylstyrene; acrylic acid methacrylic acid, maleic acid and maleic acid half esters; α-methylene aliphatic monocarboxylic acid esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylic acid esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate; and monomers having a reactive double bond such as derivatives of acrylic acid or methacrylic acid including acrylonitrile, methacrylonitrile, and acrylamide. These monomers may be used either singly or in mixture of two or more species.

In the present invention, a crosslinking agent may be used, as desired. Examples of the crosslinking agent may include: divinylbenzene, divinylnaphthalene, diethylene glycol dimethacrylate, and ethylene glycol dimethacrylate. The amount of use of the crosslinking agent may suitably be 0.1–5 wt. parts, per 100 wt. parts of the polymerizable monomer.

Further, a polymer of the above-mentioned polymerizable monomer may be added to a polymerizable monomer composition in a relatively small amount. In the present invention, it is preferred to use base particles (A1) produced from styrene, a styrene derivative having a substituent such as an alkyl group, or a monomer mixture of styrene and another monomer, in view of the developing characteristics and durability of the resultant toner.

If a polar polymer (inclusive of copolymer) or cyclized rubber is added to a polymerizable monomer to be polymerized, preferable base particles (A1) having a pseudo-capsule structure can be obtained. The polar polymer or cyclic rubber may preferably be added in an amount of 0.5–50 wt. parts, preferably 1–40 wt. parts, per 100 wt. parts of the polymerizable monomer. Below 0.5 wt. part, it is difficult to obtain a desired pseudo-capsule structure. Above 50 wt. parts, there arises an increased tendency that the characteristics of the toner are lowered because the amount of the polymerizable monomer becomes insufficient. It is preferred that a polymerizable monomer composition containing the polar polymer or cyclized rubber thus added is suspended in an aqueous medium containing a dispersant dispersed therein having a chargeability to a polarity opposite to that of the polar polymer.

The cationic polymer (inclusive of copolymer), anionic polymer (inclusive of copolymer) or anionic cyclized rubber thus contained in the polymerizable monomer composition exerts an electrostatic force at the surface of toner-forming particles with the oppositely chargeable anionic or cationic dispersant dispersed in the aqueous medium, so that the dispersant covers the surface of the particles to prevent coalescence of the particles with each other and to stabilize the dispersion. In addition, as the added polar polymer or cyclized rubber gathers at the surface layer of the particles, a sort of shell is formed to provide the particles (A1) with a pseudo-capsule structure. The polar polymer or cyclized rubber of a relatively large molecular weight thus gathered at the particle surfaces may envelop a large amount of the low-softening point compound inside thereof to provide the base particles with excellent anti-blocking characteristic, developing characteristic and abrasion resistance. Examples of the polar polymer (inclusive of copolymer and cyclized rubber) and the dispersant or dispersion stabilizer having a chargeability usable in the present invention may be raised hereinbelow. The polar polymer having a weight-average molecular weight of 5,000–500,000 as measured by GPC (gel permeation chromatography) is preferred because of good solubility in the polymerizable monomer and characteristic of providing a durable toner.

(a) Cationic polymers: polymers of nitrogen-containing monomers such as dimethylaminoethyl methacrylate and diethylaminoethyl acrylate; copolymers of styrene and such a nitrogen-containing monomer; and a ternary copolymer of styrene, an unsaturated carboxylic acid ester and such a nitrogen-containing monomer.

(b) Anionic polymers: polymers or copolymers of anionic monomers inclusive of nitrile monomers such as acrylonitrile, halogen-containing monomers such as vinyl chloride, unsaturated carboxylic acid such as acrylic acid, unsaturated dibasic acids, and unsaturated dibasic acid anhydrides; and copolymers of styrene and such an anionic monomer. Cyclized rubber having an anionic property may also be used as an anionic polymer.

The dispersant may preferably be hardly watersoluble or substantially water-insoluble inorganic fine powder capable of stabilizing the dispersion of the monomer composition particles in an aqueous medium. The amount of addition of the dispersant may preferably be 0.1–50 wt. %, particularly 1–20 wt. %, based on the water.

(c) Anionic dispersant: colloidal silica such as Aerosil #200, #300 (Nihon Aerosil K.K.).

(d) Cationic dispersant: aluminum oxide, magnesium hydroxide and hydrophilic positively chargeable silica fine powder such as aminoalkyl-modified colloidal silica obtained through treatment with a coupling agent.

In order to produce base particles (A1) containing a magnetic material, magnetic particles are added into the monomer composition. In this case, the magnetic particles also function as a colorant. The magnetic particles usable in the present invention may be those as described above.

The monomer composition may contain a colorant. The colorant may comprise known dyes or pigments as described above and also carbon black or grafted carbon black obtained by coating the surface of carbon black with a resin. The colorant may be contained in a proportion of 0.5–30 wt. % based on the total weight of the polymerizable monomer and the low-softening point compound.

In the suspension polymerization, a monomer composition comprising a polymerizable monomer and an optional additive such as colorant (and further a polymerization initiator, as desired) in a uniformly dissolved or dispersed state is dispersed in an aqueous medium, e.g., heated to a temperature which is 5° C. or more, preferably 10–30° C., higher than a subsequent polymerization temperature and containing 0.1–50 wt. % of a suspension stabilizer (e.g., hardly water-soluble inorganic dispersant) under stirring by means of an ordinary stirrer or a high-shearing force stirrer such as homomixer and homogenizer. Preferably, the speed and time for stirring and the temperature of the aqueous medium may be adjusted so that the droplets of the melted or softened monomer composition have a desired toner particle size of 30 microns or below (e.g., 2–20 microns in terms of a volume-average particle size). After that, while stirring is effected to such an extent that the dispersion state is substantially maintained as such because of the function of the dispersion stabilizer, while preventing the sedimentation, the temperature of the aqueous medium is lowered to the polymerization temperature. The polymerization temperature may be set to a temperature of 50° C. or above, preferably 55°–80° C., particularly preferably 60°–75° C. While continuing the stirring, a substantially water-insoluble polymerization initiator is added to the system to effect polymerization. The polymerization initiator can be contained in advance in the monomer composition. After the completion of the reaction, the resultant particles (A1) are washed, recovered by an appropriate method such as filtration, decantation and/or centrifugation, and dried, thereby to obtain colorless or colored base particles (A1) usable in the present invention. In the suspension polymerization, 200–3000 wt. parts of water is ordinarily used as an aqueous dispersion medium with respect to 100 wt. parts of the total weight of the polymerizable monomer and the low-softening point compound.

As another method for forming the base particles (A1), there may be alternatively used a method wherein a material in a melted state is formed into fine particles. Examples of such method may include various known methods of forming a liquid into fine droplets. More specifically, there may be used a method using a single fluid nozzle using a pressure, a dual fluid nozzle using a high-pressure gas stream, or a disk atomizer using a rotating disk.

In order to prepare base particles (A1) to be used for a heat-fixing system, the binder resin thereof or the particles (A1) per se may preferably have a softening point measured by the following method of 90°–150° C., more preferably 90°–140° C. for providing a microcapsule toner to be used in a hot fixing system.

Flow Tester Model CFT-500 (available from Shimazu Seisakusho K.K.) is used. Powder having passed through a 60-mesh sieve is used as a sample and weighed in about 1.0 to 1.5 g. The sample is pressed under a pressure of 100 kg/cm$^2$ for 1 minute by using a tablet shaper.

The pressed sample is subjected to measurement by means of Flow Tester under the following conditions:

| | |
|---|---|
| RATE TEMP | 6.0 D/M (°C./min) |
| SET TEMP | 50.0 DEG (°C.) |

-continued

| | |
|---|---|
| MAX TEMP | 200.0 DEG |
| INTERVAL | 2.5 DEG |
| PREHEAT | 300.0 SEC |
| LOAD | 20.0 KGF (kg) |
| DIE (DIA) | 0.5 MM (mm) |
| DIE (LENG) | 1.0 MM |
| PLUNGER | 1.0 $CM^2$ ($cm^2$) |

From the above measurement, the softening temperature of the sample is defined as the temperature corresponding to ½ of the stroke difference (of the piston placed on the sample) of from the resultant flow-initiation temperature to the flow-termination temperature of the sample.

The particles (A1) can also contain a charge controller as described above in connection with the particles (B).

When the microcapsule toner according to the present invention is used as a pressure-fixable toner, the particles (A1) may comprise a binder resin, such as waxes inclusive of polyethylene wax, oxidized polyethylene, paraffin, fatty acid, fatty acid ester, fatty acid amide, fatty acid metal salt and higher alcohol; ethylene-vinyl acetate resin, and cyclized rubber.

The particles (C) may comprise a binder resin for toner. Examples thereof may include; homopolymers of styrene and substituted derivatives thereof such as polystyrene; styrene copolymers such as styrene-acrylic acid ester copolymer, styrene-methacrylic acid ester copolymer, styrene-acrylonitrile copolymer, styrene-butadiene copolymer, styrene-isoprene copolymer, and styrene-acrylonitrile-indene copolymer; acrylic resins, methacrylic resins, silicone resins, polyester resins, epoxy resins, etc. In the present invention, there may preferably be used a crosslinked styrene copolymer or crosslinked polyester. Examples of comonomers to be copolymerized in the above-mentioned styrene copolymer include: monocarboxylic acids having a double bond or derivatives thereof such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, and acrylamide; dicarboxylic acids having a double bond or derivatives thereof such as maleic acid, butyl maleate, methyl maleate, and dimethyl maleate. These vinyl monomers may be used singly or as a mixture of two or more species.

Further, the crosslinking agent may generally comprise a compound having two or more polymerizable double bonds. Examples of such crosslinking agent may include: aromatic divinyl compounds such as divinylbenzene and divinylnaphthalene; carboxylic acid esters having two double bonds such as ethylene glycol diacrylate, ethylene glycol dimethacrylate, and 1,3-butanediol dimethacrylate;: divinyl compounds such as divinylaniline, divinyl ether, divinyl sulfide and divinyl sulfone; and compounds having 3 or more vinyl groups. These compounds may be used singly or as a mixture.

The resin constituting the particles (C) may preferably have a Tg of 50° C. or higher, more preferably 55° C. or higher, particularly 55°–65° C., in view of a so-called anti-blocking property for a long period of storage and a fixing performance.

When the capsule shell is desired to have a charge-controlling characteristic, it is possible to provide the resultant microcapsule toner with a stable positive chargeability by using particles (C) comprising a nitrogen-containing resin, such as styrene-dimethylaminomethyl methacrylate copolymer. It is also possible to have the particles (C) contain an ordinary charge controller.

The amount of the shell-forming resin particles (C) coating the particles (A2) depends on the surface shape, material and particle size of the particles (A2) and also the density of the particles (C) and cannot be determined independently. In the present invention, in view of the performances of the microcapsule toner, the weight of the particles (C) may be determined so as to provide a set film or shell thickness based on the following equation.

$$W=6\times\rho\times S\times\delta/(G\times D),$$

wherein:

δ: set film or shell thickness (micron)

W: weight of the particles (C),

ρ: density of the particles (C),

G: density of the particles (A2),

S: weight of the particles (A2), and

D: volume-average particle size of the particles (A2).

Generally, the set (or even actual) thickness (δ) is preferably 0.01–2.0 microns, further preferably 0.05–1.0 microns, in the present invention. If the thickness is below 0.01 micron, it is difficult to form a shell completely coating the surface of the particles (A2) and thus a defective shell is liable to be formed. As a result, it becomes difficult to exhibit a stable performance, e.g., a stable chargeability during development under a high-humidity condition. Further, in a microcapsule toner using a soft material in the particles (A1), sticking onto the sleeve or photosensitive drum tends to occur.

On the other hand, if the (set) thickness exceeds 2.0 microns, the microcapsule toner is caused to have too high a resistivity, so that the microcapsule toner is liable to form an ununiform coating on the sleeve in development under a low-humidity condition. Further, during the fixing operation, a substantial proportion of the particles (C) are not attached to the particles (A2) surfaces but form isolated particles (C), thus being liable to cause difficulties such as fog.

The microcapsule toner according to the present invention is applicable to the known dry system methods for developing electrostatic images including the two-component developing methods such as the cascade method, the magnetic brush method, the microtoning method and the two-component AC bias developing method; the one-component developing methods using a magnetic toner such as the electroconductive one-component developing method, the insulating one-component developing method and the jumping developing method; the powder cloud method and the fur brush method; the non-magnetic one-component developing method wherein the toner is carried on a toner-carrying member to be conveyed to a developing position and subjected to development thereat; and the electric field curtain method wherein the toner is conveyed by an electric field curtain to a developing position and subjected to development thereat.

In case where a microcapsule toner for a two-component developer is produced in the present invention, the carrier therefor may be composed of a metal such as iron, nickel, copper, zinc, cobalt, manganese, chromium, and rare earth elements, or of an alloy of these, in the surface-oxidized form or in the surface-non-oxidized form, or of an oxide or ferrite form of these metal or alloys. The surfaces of the carrier may be coated with a resin.

The coating material on the carrier surface may be selected depending on the material constituting the microcapsule toner and may, for example, be polytetrafluoroethylene, monochlorotrifluoroethylene polymer, polyvinylidene fluoride, silicone resin, polyester resin, metal complex of di-tertiarybutylsalicylic acid, styrene-type resin, acrylic resin, polyamide, polyvinylbutyral, nigrosine, aminoacrylate resin, basic dye or its lake, silica fine powder and alumina fine powder. These coating materials may be used singly or in combination.

The coating amount of the above coating material may be determined appropriately, but may generally be in a proportion of 0.1 to 30 wt. %, preferably 0.5–20 wt. %, in total, based on the carrier.

The carrier may have an average particle size of 20–100 microns, preferably 25–70 microns, more preferably 30–65 microns.

The carrier, in its particularly preferred form, may be composed of coated ferrite particles inclusive of ternary ferrite particles of Cu—Zn—Fe. The coating material may be a resin or a resin composition, such as a silicone resin, a fluorine-containing resin and a styrene-type resin or a mixture of these. Examples of the combination constituting the resin composition include polyvinylidene fluoride and styrene-methyl methacrylate resin; polytetrafluorooctylene and styrene-methyl methacrylate resin; and a fluorine-containing copolymer and a styrene-type copolymer. The proportions of the fluorine-containing resin and the styrene-type resin may be 90:10 to 20:80, preferably 70:30 to 30:70. It is preferred to coat the ferrite particles with 0.01 to 5 wt. %, particularly 0.1 to 1 wt. %, of the resin composition. The carrier may preferably have a particle size distribution such that particles in the range of 250 mesh-pass and 350 mesh-on occupy 70 wt. % or more. A further preferred example of the fluorine-containing resin includes vinylidene fluoridetetrafluoroethylene copolymer (10:90 to 90:10), and examples of the styrene-type copolymer include styrene-2-ethylhexyl acrylate copolymer (20:80 to 80:20) and styrene-2-ethylhexyl acrylate-methyl methacrylate copolymer (20 to 60:5 to 30:10 to 50).

The coated ferrite carrier satisfying the above conditions has a sharp particle size distribution, provides a preferable triboelectric charge characteristics to a microcapsule toner of the present invention, and provides a developer with improved electrophotographic characteristics.

A two-component developer may be prepared by mixing a microcapsule toner according to the present invention with a carrier so as to give a toner concentration in the developer of 5.0 wt. %–15 wt. %, preferably 6 wt. % to 13 wt. %, which generally provides good results. A microcapsule toner concentration of below 5.0% results in a low image density of the obtained toner image, and a toner concentration of above 15% is liable to result in increased fog and scattering of toner in the apparatus and a decrease in life of the developer.

In the present invention, a fluidity improver can be added to the microcapsule toner to improve the fluidity or flowability of the toner.

Examples of the fluidity improver may include powder of fluorine-containing resins (polyvinylidene fluoride powder, polytetrafluoroethylene powder, etc.), aliphatic acid metal salts (zinc stearate, calcium stearate, lead stearate, etc.), metal salts (zinc oxide powder), fine powder silica (wet-process silica, dry process silica, surface-treated product of such silica with a silane coupling agent, a titanate coupling agent or a silicone oil, etc.).

The fluidity-improver may be added to the toner in a proportion of 0.1 to 3 wt. parts, per 100 wt. parts of the toner.

A preferred class of fluidity improver may be fine silica powder obtained by vapor phase oxidation of silicon halide, called dry-process silica or fumed silica. Such fine silica powder may, for example, be obtained by pyrolytic oxidation of gaseous silicon tetrachloride in oxygen-hydrogen flame. The basic reaction scheme may be represented as follows:

$$SiCl_4+2H_2+O_2 \rightarrow SiO_2+4HCL$$

In the above preparation step, it is also possible to obtain complex fine powder of silica and other metal oxides by using other metal halides such as aluminum chloride or titanium chloride together with silicon halides.

It is preferred to use silica fine powder, of which mean primary particle size is desirably within the range of from 0.001 to 2 microns, particularly preferably of from 0.002 to 0.2 micron.

Further, another additive generally used in the electrophotography such as an abrasive, (particles comprising $CeO_2$, etc.) can be used in combination with the above-mentioned fluidity improver.

The present invention is described in detail below by referring to Examples. In the formulations appearing in the Examples, parts are parts by weight, unless otherwise noted specifically.

EXAMPLE 1

Preparation of Colorless Particles (A1)

| | |
|---|---|
| Styrene monomer | 160 parts |
| 2-Ethylhexyl acrylate | 25 parts |
| Cyclized rubber (Albex EK-450, mfd. by Hoechst Japan, K.K.) | 15 parts |
| Paraffin wax (mfd. by Nihon Seiro K.K.) | 10 parts |
| Vinyl-type crosslinking agent (NK-Ester 2G, mfd. by Shin-Nakamura Kagaku Kogyo K.K.) | 1 part |

The above ingredients were mixed at 60° C. for 1 hour by means of an attritor to prepare a monomer composition. Separately, 1200 parts of deionized water containing 15 parts of 0.1N-hydrochloric acid was charged into a vessel equipped with an Agi-homomixer (mfd. by Tokushu Kika Kogyo K.K.) and held therein at 60° C., into which was added and dispersed 8 parts of amino modified silica (obtained by treating colloidal silica (Aerosil #200)) with 5 wt. % of aminopropyltriethoxysilane to form an aqueous dispersing medium.

Then, into the above monomer composition, 10 parts of 2,2'-azobis-(2,4-dimethylvaleronitrile) and 1 part of 2,2'-azobisisobutyronitrile were added, and the resultant mixture was poured into the aqueous dispersing medium. Then, the homomixer was rotated at a high speed of 9000 rpm for 30 minutes to form a dispersion.

Then, the stirring means was changed from the homomixer to a paddle mixer, and the dispersion was further stirred for 16 hours while being held at 60° C. to complete the polymerization. After cooling, an excessive amount of aqueous sodium hydroxide solution was added to remove the silica by dissolution. The product was recovered by filtration and washed with water two times. The product was then left standing at 40° C. in a ventilation drier for 24 hours to obtain colorless particles (A1) having a volume-average particle size of 10.0 microns.

Preparation of Particles (B)

| | |
|---|---|
| Styrene monomer | 95 parts |
| Cyclized rubber | 5 parts |
| Chromium complex of di-tert-butylsalicylic acid | 1 part |
| Colorant (C.I. Pigment Yellow 17) | 30 parts |

The above ingredients were dispersed under heating at 60° C. by means of an attritor to form a monomer mixture to which 2 parts of 2,2'-azobis-(2,4-dimethylvaleronitrile) was added to prepare a monomer composition. Into a 2 liter-stainless steel vessel containing 15 parts of the same amino-modified silica as used for preparation of the particles (A1), 600 parts of distilled water and 30 parts of 1/10Nhydrochloric acid, the above-prepared monomer composition was added, and the mixture was stirred at 60° C. by a TK-homomixer (mfd. by Tokushu Kika Kogyo) rotating at 10,000 rpm for 60 min. for preliminary dispersion to prepare a liquid dispersion. The dispersion was then subjected to granulation by means of a piston-type high pressure homogenizer (Model 15-M8TA, mfd. by Gaulin Corp.) at an ejection pressure of 400 kg/cm$^2$. Five minutes were required for the granulation. After the granulation, the dispersion was subjected to 12 hours of stirring by a paddle blade stirrer at 60° C. to complete the polymerization.

After cooling, the product was washed with sodium hydroxide solution, dehydrated and dried to obtain particles (B), which were found to have a volume-average particle size of 1.0 micron.

Preparation of Particles (C)

| | |
|---|---|
| Styrene monomer | 95 parts |
| Cyclized rubber | 3 parts |
| Chromium complex of di-tert-butylsalicylic acid | 3 parts |

The above ingredients were dispersed under heating at 60° C. by an attritor to form a monomer mixture, to which 2 parts of 2,2,'-azobis-(2,4-dimethylvaleronitrile was added to prepare a monomer composition. Into a 2 liter-stainless steel vessel containing 7 parts of the same amino-modified silica as used for preparation of the particles (A1), 600 parts of distilled water and 30 parts of 1/10N-hydrochloric acid, the above-prepared monomer composition was added, and the mixture was stirred at 60° C. by a TK-homomixer (mfd. by Tokushu Kika Kogyo) rotating at 10,000 rpm for 60 min. for preliminary dispersion to prepare a liquid dispersion. The dispersion was then subjected to granulation by means of a piston-type high pressure homogenizer (Model 15M-8TA, mfd. by Gaulin Corp.) at an ejection pressure of 400 kg/cm$^2$. After the granulation, the dispersion was subjected to 12 hours of stirring by a paddle blade stirrer at 60° C. to complete the polymerization.

After cooling, the product was washed with sodium hydroxide solution, dehydrated and dried to obtain particles (C), which were found to have a volume-average particle size of 1.0 micron.

Then, 100 parts of the above-prepared particles (A1) and 30 parts of the above-prepared particles (B) were charged in a Henschel mixer (FM10B, mfd. by Mitsui Miike Seisakusho K.K.) as shown in FIG. 1 and stirred for mixing and dispersion at room temperature for 3 min. at a peripheral speed of the stirring vane of 30 m/sec to effect a pre-treatment. Then, the resultant mixture was further treated in an apparatus as shown in FIG. 2A for 7 min. under the conditions of a blade-tip peripheral speed of 70 m/sec, a minimum clearance of 1 mm and an ambient (process) temperature of 50° C., thereby to obtain yellow particles (A2). As a result of observation of the particles (A2) through an electron microscope, it was observed that the particles (B) were somewhat melted and fixed onto the particles (A1) as shown in FIG. 8. The observation through the electron microscope also showed that about 70% of the surface of the particles (A1) were covered by the particles.

100 parts of the thus obtained particles (A2) and 40 parts of the above-obtained particles (C) were again charged in the Henschel mixer shown in FIG. 1 and stirred for mixing and dispersion at room temperature for 3 min. at a peripheral speed of the stirring vane of 30 m/sec to effect a pretreatment. The pretreated mixture was observed through an electron microscope, whereby it was observed that the particles (C) were attached to the produced particles (A2) which were composed of the particles (A1) and the particles (B) coating most of the surface of the particles (A1).

The pretreated mixture was further treated in the apparatus shown in FIG. 2A for 10 min. under the conditions of a blade-tip peripheral speed of 70 m/sec, a minimum clearance of 1 mm and a process temperature of 55° C., thereby to obtain a yellow non-magnetic microcapsule toner. The microcapsule toner particles were observed through an electron microscope, whereby it was observed that the particles (C) were melt-fixed onto the particles (A2) and also the particles (C) were mutually melt-bonded to each other as shown in FIG. 8. The surfaces of the particles (A2) were totally enclosed by the shell formed by the particles (C), and the coverage was almost 100%.

100 parts of the microcapsule toner was mixed with 0.5 part of colloidal silica (Tullanox 500), and 10 parts of the mixture (toner) was mixed with 100 parts of ferrite carrier (obtained by coating ferrite particles of 250–300 mesh with a fluorine-containing resin and an acrylic resin) to form a developer. The triboelectric charge of the toner was measured to be $-25$ $\mu$C/g by a method wherein the developer (mixture of the toner and the carrier) were placed on a screen and sucked through the screen to separate the toner passing through the screen and the carrier not passing through the screen, the charge from the toner passing through the screen was collected through the screen an accumulated in a capacitor, and the charge thus collected was divided by the weight of the toner to provide the triboelectric charge per unit weight of the toner.

The developer was used for image formation by using a copying apparatus which had been obtained by remodeling a commercially available copying machine (NP-5540, mfd. by Canon K.K.) by changing the photosensitive drum with a silicon drum so as to be adapted to a negatively chargeable microcapsule toner, whereby clear images were obtained.

COMPARATIVE EXAMPLE 1

A microcapsule toner was prepared in the same manner as in Example 1 except that 10 parts of the particles (C) were used per 100 parts of the particles (A2). The microcapsule toner was observed through an electron microscope, whereby it was observed that about ¼ (coverage=about 25%) of the surface of the particles (A2) were covered by the particles (C).

The microcapsule toner was mixed with the colloidal silica and the carrier in the same manner as in Example 1 to prepare a developer. The triboelectric charge of the toner in the developer was measured to be −8 μC/g. The developer was used for image formation in the copying machine of Example 1, whereby the resultant images showed a low image density and were accompanied with much fog.

COMPARATIVE EXAMPLE 2

The particles (A2) per se obtained in Example 1 were mixed with the colloidal silica to prepare a toner and then mixed with the carrier to obtain a developer. The triboelectric charge of the toner in the developer was measured to be −6 μC/g. As a result of image formation, the resultant images showed a low image density and more fog than in Comparative Example 1.

COMPARATIVE EXAMPLE 3

A microcapsule toner was prepared in the same manner as in Example 1 except that 19 parts of the particles (C) were used per 100 parts of the particles (A2). The microcapsule toner was observed through an electron microscope, whereby it was observed that nearly a half (coverage=48%) of the surface of the particles (A2) were covered by the particles (C).

The microcapsule toner was mixed with the colloidal silica and the carrier in the same manner as in Example 1 to prepare a developer. The triboelectric charge of the toner in the developer was measured to be −16 μC/g. The developer was used for image formation in the copying machine of Example 1, whereby the resultant images showed an image density which was lower than that in Example 1 but was sufficient. However, the images were accompanied with clearly more noticeable fog that in Example 1.

EXAMPLE 2

The same particles (A1) and particles (C) as in Example 1 were used.

Preparation of Colored Particles (B)

| | |
|---|---|
| Styrene monomer | 90 parts |
| Styrene-dimethylaminoethyl methacrylate copolymer (copolymerization ratio = 9:1, Mw = 5,000) | 10 parts |
| Colorant (C.I. Pigment Yellow 17) | 30 parts |

The above ingredients were dispersed under heating at 60° C. by means of an attritor to form a monomer mixture to which 2 parts of 2,2'-azobis-(2,4-dimethylvaleronitrile) was added to prepare a monomer composition. Into a 2 liter-stainless steel vessel containing 700 parts of distilled water and 15 parts of hydrophilic silica (Aerosil #300, available from Nihon Aerosil K.K.) held at 60° C., the above-prepared monomer composition was added, and the mixture was stirred by a TK-homomixer rotating at 10,000 rpm for 60 min. for preliminary dispersion to prepare a liquid dispersion. The dispersion was then subjected to granulation by means of a piston-type high pressure homogenizer (Model 15M-8TA) at an ejection pressure of 400 kg/cm$^2$. After the granulation, the dispersion was subjected to 8 hours of stirring by a paddle blade stirrer at 60° C. to complete the polymerization.

After cooling, the product was washed with sodium hydroxide solution, dehydrated and dried to obtain particles (B), which were found to have a volume-average particle size of 1.05 micron.

Then, 100 parts of the particles (A1) and 30 parts of the above-prepared particles (B) were subjected to a pretreatment in the Henschel mixer in the same manner as in Example 1. Then, the resultant pretreated mixture was further treated for fixation in an apparatus as shown in FIG. 2A in the same manner as in Example 1 except for the conditions of the processing time (circulation time) of 10 min. a minimum clearance of 1 mm and a process temperature of 55° C., thereby to obtain yellow particles (A2).

Then, 100 parts of the thus-prepared particles (A2) and 45 parts of the particles (C) were pretreated in the same manner as in Example 1 and further treated for fixation in the same manner as in Example 1 except for the conditions of a minimum clearance of 1 mm and a process temperature of 60° C., thereby to obtain a yellow non-magnetic microcapsule toner. The microcapsule toner particles were observed through an electron microscope, whereby it was observed that the surfaces of the particles (A2) were totally enclosed by a substantially smooth shell formed by the particles (C), and the coverage was almost 100%.

100 parts of the microcapsule toner was mixed with 0.8 part of colloidal silica treated with an aminosilicone oil, and 10 parts of the mixture (toner) was mixed with 100 parts of the above-mentioned ferrite carrier to form a two-component developer. The triboelectric charge of the toner in the developer was measured to be +21 μC/g.

The developer was used for image formation by using a copying apparatus which had been obtained by remodeling a commercially available copying machine (NP-3525, mfd. by Canon K.K.) with respect to the structure of the developing unit, whereby clear images free from fog were obtained with a sufficient image density.

COMPARATIVE EXAMPLE 4

The particles (A2) per se obtained in Example 2 were used as a yellow microcapsule toner and mixed with the colloidal silica to prepare a toner and then mixed with the carrier to obtain a developer in the same manner as in Example 2. The triboelectric charge of the toner in the developer was measured to be +1.5 μC/g. As a result of image formation in the same manner as in Example 2, the resultant images were extremely thin and not worth evaluation.

EXAMPLE 3

| | |
|---|---|
| Polyethylene wax (PE-130, Hoechst Japan K.K.) | 100 parts |
| Hydrophobic colloidal silica (Aerosil R-972, Nihon Aerosil K.K.) | 5 parts |

The above ingredients were dispersed at 135° C. by an attritor, then taken out, cooled and crushed by a cutter mill. The product was further pulverized after refrigeration, and then classified to obtain particles (A1) having a volume-average particle size of 13.3 microns. The particles (A1) in an amount of 100 parts, 5 parts of colored particles (B) composed of phthalocyanine blue (colorant) alone and 0.2 part of colloidal silica (Aerosil #300) were charged in a Henschel mixer (FM 10B) and subjected to a pretreatment for 1 min. at a peripheral speed of 20 msec. As a result of observation through an electron microscope, the particles (B) and colloidal silica were uniformly attached to the surfaces of the particles (A1).

Then, the resultant mixture was further treated in an apparatus as shown in FIG. 2A for 3 min. under the conditions of a blade-tip peripheral speed of 50 m/sec, a minimum clearance of 2 mm and a process temperature of 40° C., thereby to obtain particles (A2) wherein the particles (B) were fixed onto the particles (A1).

100 parts of the thus obtained particles (A2) was mixed with 0.2 part of colloidal silica (Aerosil #300) for improving the fluidity, and the mixture and 40 parts of the particles (C) obtained in Example 2 were charged in the Henschel mixer and stirred for mixing and dispersion to effect a pretreatment.

The pretreated mixture was further treated in the apparatus shown in FIG. 2A for 8 min. of circulation under the conditions of a blade peripheral speed of 60 m/sec, a minimum clearance of 2 mm and a process temperature of 45° C., thereby to obtain a cyan microcapsule toner. The microcapsule toner particles were observed through an electron microscope, whereby it was observed that the surfaces of the particles (A2) were totally covered by the shell formed by the particles (C), and the coverage was almost 100%.

100 parts of the cyan microcapsule toner was externally mixed with 1.0 part of colloidal silica treated with an aminosilicone oil, and 6 parts of the mixture (toner) was mixed with 100 parts of the abovementioned ferrite carrier to form a two-component developer. The triboelectric charge of the toner was measured to be +18 μC/g.

The developer was used for image formation by using a copying apparatus which had been obtained by remodeling a commercially available copying machine (PC-9, mfd. by Canon K.K.) so as to increase the fixing pressure, whereby very clear cyan images were obtained without fog.

As described above, the microcapsule toner prepared by the present invention provides good color images free from fog. The microcapsule toner is produced at a low cost and is sufficiently applicable to color toners which are produced in a variety of types each in a small amount. Thus, the process of the invention is suitable for production of microcapsule toners capable of fully exhibiting the characteristics of the respective ingredients.

EXAMPLE 4

| | |
|---|---|
| Styrene monomer | 170 parts |
| 2-Ethylhexyl acrylate | 30 parts |
| Styrene-dimethylaminoethyl methacrylate copolymer (dimethylaminoethyl methacrylate 10 mol %, Mw = 50,000) | 15 parts |
| Vinyl-type crosslinking agent (NK-Ester 2G, Shin-Nakamura Kagaku K.K.) | 1.1 parts |
| Carbon black | 15 parts |

-continued

| |
|---|
| (STERING R, Cabot Co., U.S.) |

The above ingredients were mixed at 60° C. for 4 hours by means of an attritor to prepare a monomer mixture, to which were further added 10 parts of 2,2'-azobis-(2,4-dimethylvaleronitrile) and 1 part of 2,2'-azobisisobutyronitrile to prepare a monomer composition. Separately, an aqueous medium was prepared by adding 12 parts of hydrophilic colloidal silica (Aerosil #200, Nihon Aerosil K.K.) which was negatively chargeable in water into 1200 parts of deionized water. Into the aqueous medium warmed at 60 ° C. under stirring by means of a TK-homomixer, the above-prepared monomer composition was charged, and then the homomixer was stirred for 20 min. at 10,000 rpm for dispersion and granulation. Then, the stirring means was changed from the homomixer to a paddle blade stirrer, and the stirring was continued for 10 hours at 60° C. to complete the polymerization. After cooling, the polymer particles were washed with a sodium hydroxide solution to remove the silica by dissolution. The polymer particles were further washed with water, dehydrated, dried and classified to obtain particles (A1) having a volume-average particle size of 8.5 microns. The particles (A1) showed a softening point of 115° C.

Fine powder of tin oxide-antimony oxide mixed crystal (resistivity: 1-5 ohm.cm, particle size: 0.1 micron, density: 6.6; T-1, mfd. by Mitsubishi Kinizoku K.K.) was used as charge-suppressing particles (B).

Then, 1000 parts of the above-prepared particles (A1) and 20 parts of the particles (B) were charged in a Henschel mixer (FM10B, mfd. by Mitsui Miike Seisakusho K.K.) as shown in FIG. 1 and stirred for mixing and dispersion for 5 min. at a peripheral speed of the stirring vane of 30 m/sec to effect a pretreatment. Then, the resultant mixture was further treated in an apparatus as shown in FIG. 2A for 3 min. under the conditions of a peripheral speed of the blade 15 tip of 60 m/sec, a minimum clearance of 1 mm and an ambient (process) temperature (temperature in the chamber) of 50° C., thereby to obtain particles (A2) with a coverage of 6.4%. As a result of observation of the particles (A2) through an electron microscope, it was observed that the particles (B) were partially fixed onto the particles (A1).

Polymethyl methacrylate fine powder having an average particle size of 0.4 microns was used as particles (C), and 1000 parts of the thus obtained particles (A2) and 120 parts of the particles (C) were charged in the Henschel mixer shown in FIG. 1 and stirred for 5 min. at a peripheral speed of the stirring vane of 30 m/sec to effect a pretreatment.

The pretreated mixture was further treated in the apparatus shown in FIG. 2A for 3 min. under the conditions of a black peripheral speed of 70 m/sec, a minimum clearance of 1 mm and a process temperature of 75° C., thereby to obtain a microcapsule toner. The microcapsule toner particles were observed through an electron microscope, whereby it was observed that the particles (C) were melt-fixed onto the particles (A2).

100 parts of the microcapsule toner was mixed with 0.5 part of colloidal silica treated with an aminosilicone oil, and 10 parts of the mixture (toner) was mixed with 100 parts of ferrite carrier (obtained by coating 100 parts of ferrite particles of 250-300 mesh with 0.5 part of a silicone resin) to form a twocomponent developer.

The developer was used for image formation by using a commercially available copying machine (NP-3525, mfd. by Canon K.K.), whereby good images were obtained under the normal temperature-normal humidity conditions, and no charge-up phenomenon was observed to cause little fog even during successive copying operation under low temperature-low humidity conditions. Further, good images were obtained without image flow.

EXAMPLE 5

| | |
|---|---|
| Styrene-butylacrylate-divinylbenzene copolymer ($Mw = 3 \times 5^5$) | 90 parts |
| Nigrosin (Orient Kagaku K.K.) | 2 parts |
| Polyethylene wax (Hi-Wax 200P, Mitsui Sekiyu Kagaku K.K.) | 4 parts |
| Carbon black (STERING R) | 10 parts |

The above ingredients were kneaded by a roll mill at 150° C. for 30 min., and the kneaded product was cooled and pulverized to a volume-average particle size of about 10 microns, followed by removal of coarse powder and fine powder by two zig-zag classifiers (Alpine Co.) so as to provide a volume-average particle size of about 9 microns, thereby to obtain particles (A1). The softening point of the particle size (A1) was 120° C.

Then, 1000 parts of the above-prepared particles (A1) and 20 parts of the particles (B) used in Example 4 were charged in a Henschel mixer (FM10B) and stirred for 5 min. at a peripheral speed of the stirring vane of 30 m/sec to effect a pre-treatment. Then, the resultant mixture was further treated in an apparatus as shown in FIG. 2A for 5 min. under the conditions of a blade-tip peripheral speed of 60 m/sec, a minimum clearance of 1 mm and an ambient (process) temperature of 55° C., thereby to obtain particles (A2) with a coverage of 6.8%.

1000 parts of the thus obtained particles (A2) and 140 parts of the particles (C) of 0.4 micron-dia. polymethyl methacrylate fine powder used in Example 4 were charged in the Henschel mixer shown in FIG. 1 and stirred for mixing and dispersion at room temperature for 5 min. at a peripheral speed of the stirring vane of 30 m/sec to effect a pretreatment.

The pretreated mixture was further treated in the apparatus shown in FIG. 2A for 3 min. under the conditions of a black peripheral speed of 70 m/sec, a minimum clearance of 1 mm and a process temperature of 80° C., thereby to obtain a microcapsule toner with a coverage by the particles (C) of 82%. The microcapsule toner particles were observed through an electron microscope, whereby it was observed that the particles (C) were fixed onto the particles (A2).

Thereafter, a developer was prepared by using the microcapsule toner and used for image formation in the same manner as in Example 4, whereby good images were obtained without fog during successive copying operation.

EXAMPLE 6

| | |
|---|---|
| Styrene monomer | 170 parts |
| 2-Ethylhexyl acrylate | 30 parts |
| Cyclized rubber (Albex EK-450, mfd. by Hoechst Japan, K.K.) | 15 parts |

-continued

| | |
|---|---|
| Chromium complex of di-tert-butylsalicylic acid | 2 parts |
| Vinyl-type crosslinking agent (NK-Ester 2G, Shin-Nakamura Kagaku K.K.) | 1.1 parts |
| Carbon black (STERING R, Cabot Co., U.S.) | 15 parts |

The above ingredients were mixed at 60° C. for 4 hours by means of an attritor to prepare a monomer mixer, to which were further added 10 parts of 2,2'-azobis-(2,4-dimethylvaleronitrile) and 1 part of 2,2'-azobisisobutyronitrile to prepare a monomer composition. Separately, an aqueous medium was prepared by adding 12 parts of the amino-modified silica used in Example 1 and 15 parts of 0.1Nhydrochloric acid into 1200 parts of deionized water. Into the aqueous medium warmed at 60° C. under stirring by means of a TK-homomixer, the above-prepared monomer composition was charged, and then the homomixer was stirred for 15 min. at 10,000 rpm for dispersion and granulation. Then, the stirring means was changed from the homomixer to a paddle blade stirrer, and the stirring was continued for 10 hours at 60° C. to complete the polymerization. After cooling, the polymer particles were washed with a sodium hydroxide solution to remove the amino-modified silica by dissolution. The polymer particles were further washed with water, dehydrated, dried and classified to obtain particles (A1) having a volume-average particle size of 8.5 microns. The particles (A1) showed a softening point of 115° C.

The particles (A1) was thereafter subjected to the fixing operations of the same charge-suppressing particles (B) and particles (C) as used in Example 4 in the same manner as in Example 4 to prepare a microcapsule toner and then a developer. The developer was used for image formation by using a developing apparatus shown in FIG. 5, whereby good images were obtained.

Figure 5:
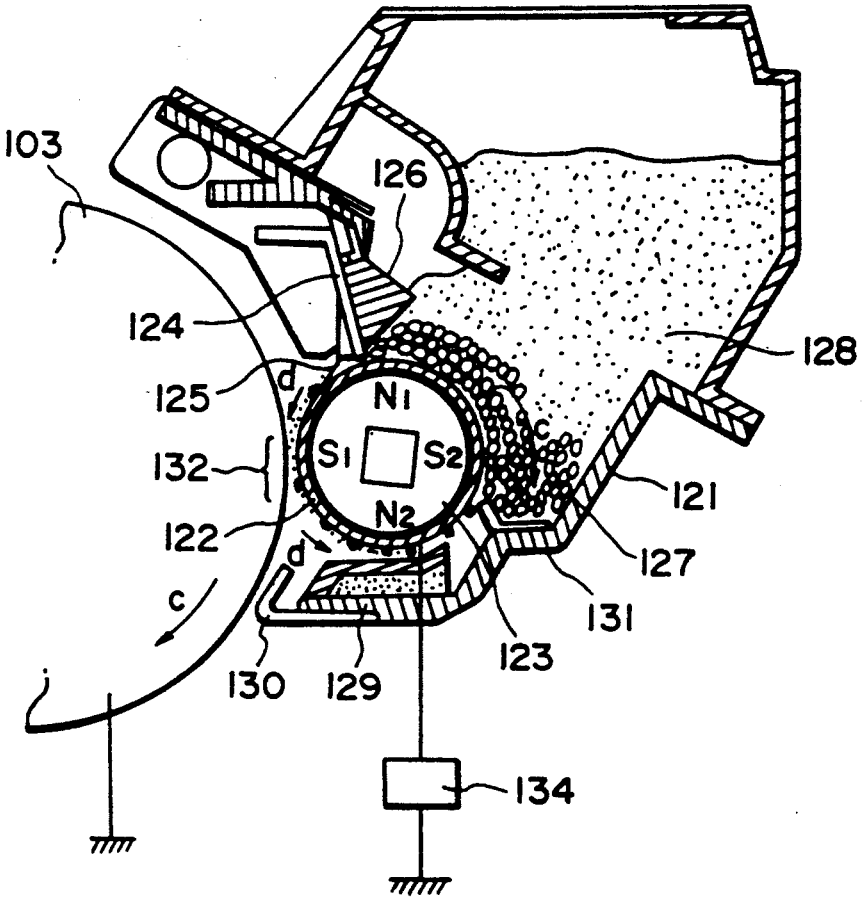
FIG. 5 is a schematic sectional view showing an image-forming device for effecting image formation by using a microcapsule toner obtained in the present invention.
Figure 6:
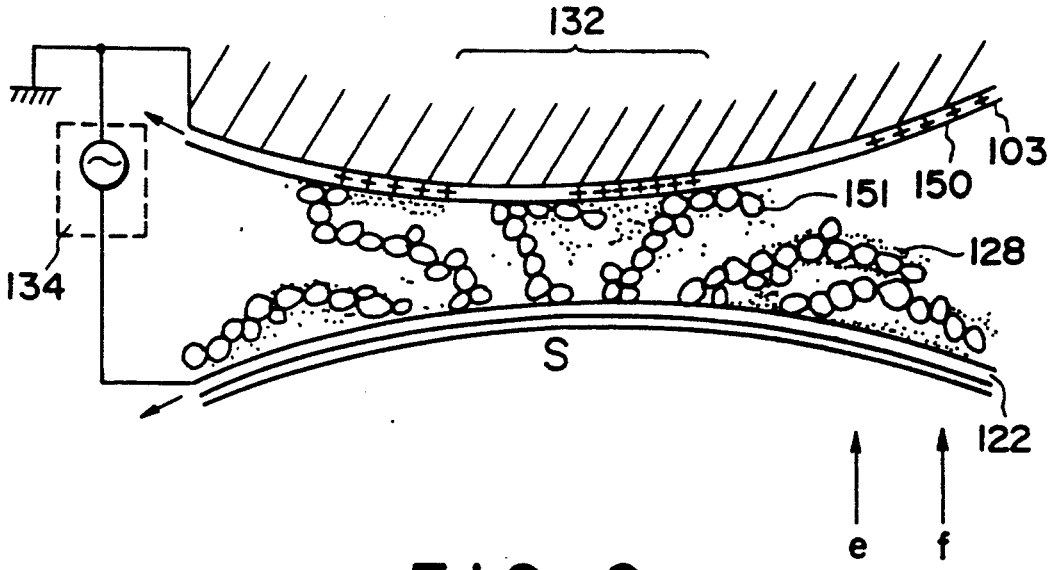
FIGS. 6 and 7 are enlarged schematic sectional views each showing a developing zone in the image-forming device shown in FIG. 5.
Figure 7:
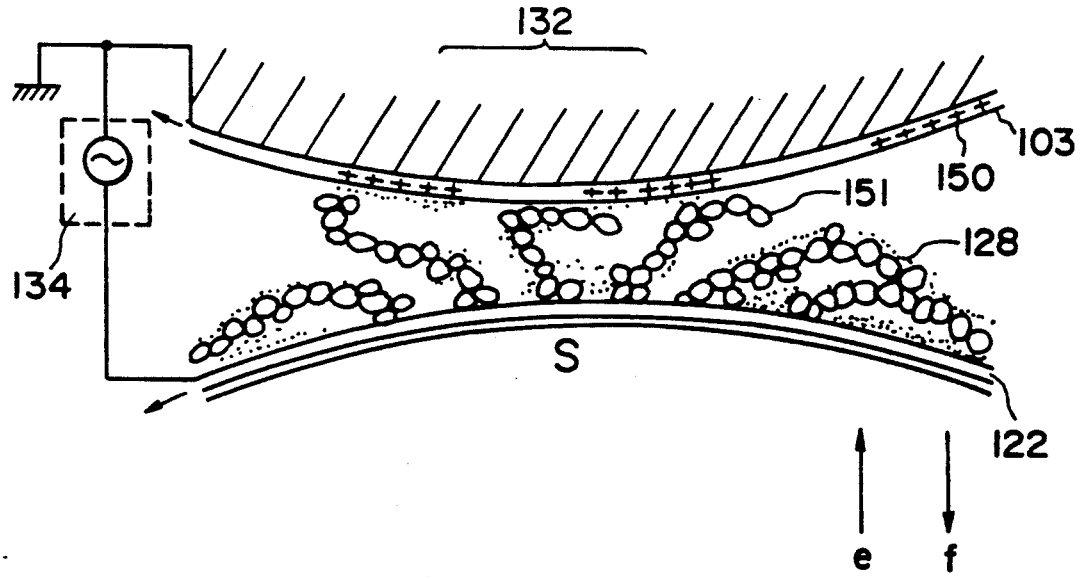

Incidentally, the developing apparatus shown in FIG. 5 comprises a photosensitive drum 103, a developer container 121, a non-magnetic sleeve 122, a fixed magnet 123, a non-magnetic blade 124, a member 126 for limiting a circulation region for magnetic particles, a container portion 129 for collecting a developer, a member 130 for preventing a scattering, a magnetic member 131 and a bias power supply 134. In FIG. 5, a reference numeral 127 denotes magnetic particles (carrier), numeral 128 denotes a non-magnetic toner, and numeral 132 denotes a developing zone. Further, FIG. 6 and FIG. 7 are enlarged views of the developing zone of the apparatus shown in FIG. 5. In FIGS. 6 and 7, an arrow e denotes the direction of the electric field based on a DC bias component, and an arrow f denotes that based on an AC bias component.

Referring to FIG. 5, in this instance, the photosensitive drum 103 rotates in the direction of an arrow c at a peripheral speed of 60 mm/sec, and the sleeve 122 comprised a hollow cylinder of stainless steel (SUS 304) having an outside diameter of 32 mm and a thickness of 0.8 mm, and rotated in the direction of an arrow d at a peripheral speed of 66 mm/sec. The surface of the sleeve had been subjected to a irregular-shape sandblasting by using an Alundum abrasive (#600).

On the other hand, the fixed magnet 123 of a ferrite-sinter type having poles of N1, N2, S1 and S2 was disposed in the rotating sleeve 122. Thus, a maximum magnetic flux density of about 800 Gauss was exerted to the surface of the sleeve (developer-carrying member).

The non-magnetic blade 124 comprised non-magnetic stainless steel and has a thickness of 1.2 mm. The blade 124 and the sleeve 122 were disposed at a gap of 400 microns. The sleeve 122 and the photosensitive drum 103 were disposed opposite to each other at a gap of 300 microns..

On the surface of the photosensitive drum 103, an electrostatic latent image 150 of a charge pattern comprising a dark portion of +600 V and a bright portion of +150 V was formed. A bias voltage having a frequency of 800 Hz, a peak-to-peak value of 1.4 KV and a central value of +300 V was applied to the sleeve 122 by means of the power supply 134. Thus, as shown in FIGS. 6 and 7, the electrostatic image formed on the photosensitive drum 103 was developed by using a magnetic brush 151.

COMPARATIVE EXAMPLE 5

0.5 wt. part of colloidal silica treated with aminosilicone oil was externally added to the particles (A1) prepared in Example 4 to prepare a toner. Image formation was performed by using the toner instead of the microcapsule toner otherwise in the same manner as in Example 4, whereby fog was observed in successive copying operation.

COMPARATIVE EXAMPLE 6

0.2 part of the charge-suppressing particles (B) used in Example 5 was added to 100 parts of the ingredients for providing the particles (A1) in Example 5 and thereafter the mixture was kneaded, cooled, pulverized and classified in the same manner as in Example 5 to obtain a toner having a volume-average particle size of 9 microns. Thereafter, image formation was performed by using the toner instead of the microcapsule toner otherwise in the same manner as in Example 4, whereby fog was observed in successive copying operation.

As described above, the process for producing a microcapsule toner according to the present invention can easily produce a microcapsule toner which provides high-quality images under various environmental conditions and is therefore industrially very valuable.

EXAMPLE 7

| | |
|---|---|
| Styrene-ethyl acrylate copolymer [St-EA] Copolymerization wt. ratio = 7.3, Mw = $2 \times 10^5$) | 100 parts |
| Magnetite [MG] | 80 parts |
| Low-molecular weight polyethylene [PE] (Mw = 3,000) | 2 parts |

The above ingredients were preliminarily blended in a Henschel mixer and melt-kneaded at 180° C. for 1 hour in a roll mill. The kneaded product cooled by standing was coarsely crushed by a hammer mill to a particle size on the order of 100–1000 microns and finely pulverized by ACM Pulverizer (Hosokawa Micron K.K.) to obtain a fine pulverized product having an average particle size of about 11 microns. The fine pulverized product was introduced into a multi-division classifier (Elbow Jet) to simultaneously remove fine powder and coarse powder to obtain colored particles (A1). The thus-obtained colored particles (A1) has a volume-average particle size of 11.5 microns and a volumetric variation coefficient (variance) of 11%.

On the other hand, charge-controlling particles (B) were prepared by repeatedly pulverizing nigrosin by means of a jet mill under cooling, and classifying the pulverized product by means of a wind-force classifier to recover a fraction having a volume-average particle size of 0.2 micron and a volumetric variation coefficient of 5%. The particles (B) showed a triboelectric chargeability of +30 μC/g and a particle size ratio of 0.018 with respect to the particles (A1).

Then, 100 parts of the above-prepared particles (A1) and 1.8 parts (coverage=40%) of the above-prepared particles (B) were charged in a Henschel mixer as shown in FIG. 1 and stirred for mixing in the same manner as in Example 1 to effect a pretreatment. Then, the resultant mixture was further treated in an apparatus as shown in FIG. 3A for 2 min. under the conditions of a blade-tip peripheral speed of 60 m/sec, a minimum clearance of 1 mm and a process temperature of 50° C., thereby to obtain particles (A2).

The particle size distribution of the particles (A2) was measured by dispersing the particles in the presence of an anionic surfactant. The volume-average particle size was measured to be 11.6 microns, and the increase of a fine powder fraction was not observed, so that it was understood that the particles (B) was fixed onto the particles (A1). Separately, the fixation was also confirmed by observation through a scanning electron microscope.

Particles (C) were prepared in the following manner. Into a 2 liter-four necked flask equipped with a refluxing condenser, 1 liter of deionized water and 1.5 g of sodium lauryl sulfate were added, and a sodium bicarbonate solution was added thereto to control the pH at 10 in advance. In this system, 200 ml of styrene monomer was added and stirred vigorously by a homomixer to be emulsified. While nitrogen gas was flowed into the system at a rate of 1 liter/min., the content was heated to 75° C. On reaching the constant temperature, 1 g of potassium persulfate was added to initiate the polymerization reaction. The reaction was continued for about 3 hours, and then the inner temperature was raised to 80° C., at which the system was held for 1 hour to complete the polymerization. The resultant latex was subjected to dialysis and treated with an ion-exchange resin to be purified by removing the activator and oligomer. The lustrous latex after the treatment was dried by using a spray drier to obtain spherical polystyrene particles (C) having a volume-average particle size of 0.3 micron.

17 parts of the particles (C) and 100 parts of the already obtained particles (A2) were mixed by a Henschel mixer shown in FIG. 1 in the same manner as in Example 1 and then again charged in the apparatus shown in FIG. 3A for encapsulation under the same conditions.

As a result, a microcapsule toner having a film thickness of 0.5 micron was obtained and showed a triboelectric charge of +12 μC/g. Positively chargeable hydrophobic silica was externally added to the microcapsule toner to obtain a toner. The toner was evaluated by using a copying machine obtained by re-modeling a commercially available machine (NP-3525, Canon K.K.). Good images were obtained with very little fog both during successive copying and at the time of replenishment of the toner. The toner also showed such good environmental characteristics as to provide an image density of 1.35 under the conditions of temperature of 15° C. and 10%RH and an image density of 1.30 under the conditions of temperature of 32.5° C. and 90%RH. Further, no sticking was observed on the drum.

EXAMPLES 8-11

Various types of microcapsule toners were prepared in the same manner as in Example 7 except for the conditions given in the following Table 1.

Each microcapsule toner gave good results in image evaluation.

TABLE

| Ex. No. | Particle (A1) Material | Particle (A1) Size (μm)/variance | Particle (B) Material | Particle (B) Size (μm)/variance | Size ratio (B)/(A) | Coverage (%) | Particle (C) Material | Particle (C) Size (μm)/variance | Thickness (μm) | Triboelectric charge (μc/g) |
|---|---|---|---|---|---|---|---|---|---|---|
| 7 | St-EA/PE/MG | 11.5/11.0 | nigrosin | 0.2/5.0 | 0.018 | 40 | styrene | 0.3/6.0 | 0.5 | +12 |
| 8 | St/EA/PE/MG | 11.5/11.0 | nigrosin | 0.2/5.0 | 0.018 | 40 | styrene | 0.3/6.0 | 1.5 | +15 |
| 9 | St/EA/PE/MG | 11.5/11.0 | nigrosin | 0.2/5.0 | 0.018 | 15 | PMMA | 0.4/5.2 | 1.5 | +17 |
| 10 | St/EA/PE/MG | 10.5/5.5 | Bontron* | 0.2/6.0 | 0.019 | 40 | styrene | 0.3/6.0 | 0.5 | −11 |
| 11 | St/EA/PE/MG | 11.0/11.0 | Bontron* | 0.7/9.0 | 0.070 | 15 | St-EA | 0.35/8.0 | 1.5 | −13 |

*Bontron E81 (chromium complex of dialkylsalicyclic acid) showed a triboelectric charge of −50 μC/g.

As described above, the microcapsule toner according to the present invention is obtained by fixing charge-controlling particles (B) under the action of a mechanical impact. Accordingly, in the microcapsule toner obtained according to the present invention, the particles (B) are not essentially isolated from but move integrally with the microcapsule toner in subsequent steps.

Further, the amount of a charge controller at the surface part of the microcapsule toner is controlled by the amount of addition to ensure uniform presence thereof so that a uniform triboelectric chargeability is attained during successive copying and stable images are formed at a constant image density.

In the microcapsule toner of the present invention, it is possible to have the charge controller be present only at the surface of the particles (A1), so that the amount of addition can be reduced to less than 1/5 (e.g., 1/10) of the conventional amount.

Further, in the microcapsule toner produced by the present invention, the charge controller is fixed at the surface of the particles (A1), so that good developing performance is exhibited without causing carrier contamination or sleeve contamination.

EXAMPLE 12

| | |
|---|---|
| Styrene monomer | 170 parts |
| 2-Ethylhexyl acrylate | 30 parts |
| Cyclized rubber (Albex EK-450, mfd. by Hoechst Japan, K.K.) | 18 parts |
| Chromium complex of di-tert-butylsalicylic acid | 2 parts |
| Vinyl-type crosslinking agent (NK-Ester 2G, Shin-Nakamura Kagaku K.K.) | 1 part |
| Carbon black (STERING R, Cabot Co., U.S.) | 20 parts |
| Paraffin wax (Nihon Seiro K.K.) | 1 part |

The above ingredients were mixed at 60° C. for 4 hours by means of an attritor to prepare a monomer mixture, to which were further added 10 parts of 2,2'-azobis-(2,4-dimethylvaleronitrile) and 1 part of 2,2'-azobisisobutyronitrile to prepare a monomer composition. Separately, an aqueous medium was prepared by adding 10 parts of the amino-modified silica used in Example 1 and 15 parts of 0.1N-hydrochloric acid into 1200 parts of deionized water. Into the aqueous medium warmed at 60° C. under stirring by means of a TK-homomixer, the above-prepared monomer composition was charged, and then the homomixer was stirred for 25 min. at 10,000 rpm for dispersion and granulation. Then, the stirring means was changed from the homomixer to a paddle blade stirrer, and the stirring was continued for 10 hours at 60° C. to complete the polymerization. After cooling, the polymer particles were washed with a sodium hydroxide solution to remove the amino-modified silica by dissolution. The polymer particles were further washed with water, dehydrated, dried and classified to obtain particles (A1) having a volume-average particle size of 9.0 microns. The particles (A1) showed a softening point of 110° C.

Polyethylene fine particles (softening point: 80° C.) having a volume-average particle size of 1 micron were used as particles (B), and 100 parts of the above-prepared particles (A1) and 0.8 part of the particles (B) were charged in a Henschel mixer (FM10B) and stirred for 1 min. at a peripheral speed of the stirring vane of 30 m/sec to effect a pre-treatment. Then, the resultant mixture was further treated in an apparatus as shown in FIG. 2A for 1 min. under the conditions of a blade-tip peripheral speed of 70 m/sec, a minimum clearance of 1 mm and a process temperature of 45° C., thereby to obtain particles (A2) with a volume-average particle size of 9.0 microns.

100 parts of the thus obtained particles (A2) and 12 parts of polymethyl methacrylate fine particles (C) having an average particle size of 0.4 micron were again charged in the Henschel mixer shown in FIG. 1 and stirred for 1 min. at a peripheral speed of the stirring vane of 30 m/sec to effect a pretreatment.

The pretreated mixture was further treated in the apparatus shown in FIG. 2A for 3 min. under the conditions of a block peripheral speed of 70 m/sec, a minimum clearance of 1 mm and a process temperature of 60° C., thereby to obtain a microcapsule toner with a coverage by the particles (C) of 88%.

100 parts of the microcapsule toner was externally mixed with 0.5 part of hydrophobic colloidal silica and 10 parts of the mixture (toner) was mixed with 100 parts of ferrite carrier (obtained by coating 100 parts of ferrite particles of 250–300 mesh with 0.8 part of silicone resin) to form a developer.

The developer was charged in a developing apparatus to form a toner image on plane paper, which was then fixed by a fixing device for a copying machine (NP7550, Canon K.K.) at a temperature (fixing roller surface temperature) of 170° C., whereby a good fixing performance was exhibited including satisfying anti-offset characteristic and anti-winding characteristic.

EXAMPLE 13

Releasing particles (B) were prepared in the following manner.

| | |
|---|---|
| Styrene polymer (Mw = 20,000) | 100 parts |

-continued

| | |
|---|---|
| Polyethylene wax (S.P. = 130° C., Hi-Wax 200P, Mitsui Sekiyu Kagaku) | 10 parts |

The above mixture was kneaded in a roll mill and, after cooling, coarsely crushed by a speed mill and pulverized under refrigeration by a jet mill to obtain particles having a volume-average particle size of 1 micron with less than 5% thereof being 2 micron or larger.

Then, 100 parts of the above-prepared particles (A1) and 8 parts of the above-prepared particles (B) were charged in a Henschel mixer (FM10B) as shown in FIG. 1 and stirred for 1 min. at a peripheral speed of 30 m/sec to effect a pre-treatment. Then, the resultant mixture was further treated in an apparatus as shown in FIG. 2A for 2 min. under the conditions of a blade-tip peripheral speed of 70 m/sec, a minimum clearance of 1 mm and a process temperature of 52° C., thereby to obtain particles (A2) with a volume-average particle size of 9.2 microns.

Then, 100 parts of the above-prepared particles (A2) and 20 parts of polymethyl methacrylate fine particles (C) with an average particle size of 0.4 micron were again charged in a Henschel mixer (FM10B) and stirred for 1 min. at a peripheral speed of 30 m/sec to effect a pre-treatment. Then, the resultant mixture was further treated in an apparatus as shown in FIG. 2A for 3 min. under the conditions of a bladetip peripheral speed of 70 m/sec, a minimum clearance of 1 mm and a process temperature of 60° C., thereby to obtain a microcapsule toner with a coverage of the particles (A2) by the particles (C) of 89% as calculated.

100 parts of the microcapsule toner was externally mixed with 0.5 part of colloidal silica, and 10 parts of the mixture (toner) was further mixed with 100 parts of ferrite carrier (obtained by coating 100 parts of ferrite particles of 250–300 mesh with 0.8 part of silicone resin) to form a developer.

The developer was charged in a developing apparatus to form a toner image on plane paper, which was then fixed by a fixing device for a copying machine (NP7550, Canon K.K.) at a temperature (fixing roller surface temperature) of 170° C., whereby a good fixing performance was exhibited including satisfactory anti-offset characteristic and anti-winding characteristic.

EXAMPLE 14

| | |
|---|---|
| Styrene monomer | 170 parts |
| 2-Ethylhexyl acrylate | 30 parts |
| Cyclized rubber (Albex EK-450, mfd. by Hoechst Japan, K.K.) | 18 parts |
| Chromium complex of di-tert-butylsalicylic acid | 2 parts |
| Vinyl-type crosslinking agent (NK-Ester 2G, Shin-Nakamura Kagaku K.K.) | 1 parts |
| Carbon black (STERING R, Cabot Co., U.S.) | 20 parts |

Particles (A1) were prepared in the same manner as in Example 12 except for using the above prescription.

Particles (A2) were prepared by using 100 parts of the above particles (A1) and 15 parts of the particles (B) prepared in Example 12 in the same manner as in Example 12.

Then, 100 parts of the above-prepared particles (A1) and 15 parts of polymethyl methacrylate fine particles (C) with an average particle size of 0.4 micron were charged in a Henschel mixer and stirred for 1 min. at a peripheral speed of 30 m/sec to effect a pre-treatment. Then, the resultant mixture was further treated in an apparatus as shown in FIG. 2A for 3 min. under the conditions of a blade-tip peripheral speed of 70 m/sec, a minimum clearance of 1 mm and a process temperature of 50° C., thereby to obtain a microcapsule toner with a coverage of the particle size (A) by the particles (C) of 92% as calculated.

100 parts of the microcapsule toner was externally mixed with 0.5 part of colloidal silica, and 10 parts of the mixture (toner) was further mixed with 100 parts of ferrite carrier (obtained by coating 100 parts of ferrite particles of 250–300 mesh with 0.8 part of silicone resin) to form a two-component developer.

The developer was charged in a developing apparatus to form a toner image on plane paper, which was then fixed by a fixing device for a copying machine (NP7550, Canon K.K.) at a temperature (fixing roller surface temperature) of 170° C., whereby a good fixing performance was exhibited including satisfactory anti-offset characteristic and anti-winding characteristic.

EXAMPLE 15

| | |
|---|---|
| Styrene-butylacrylate-divinylbenzene copolymer (Mw = $3 \times 5^5$) | 90 parts |
| Chromium complex of di-tert-butylsalicylic acid | 2 parts |
| Carbon black (STERING R) | 10 parts |

The above ingredients were kneaded at 150° C. for 30 min., and the kneaded product was cooled and pulverized to a volume-average particle size of about 10 microns, followed by removal of fine powder by a zig-zag classifier (Alpine Co.) so as to provide a volume-average particle size of about 11 microns, thereby to obtain particles (A1). The softening point of the particles (A1) was 120° C.

Then, 100 parts of the above-prepared particles (A1) and 1 part of polyethylene fine particles (B) with a volume-average particle size of 1 micron were charged in a Henschel mixer (FM10B) and stirred for 1 min. at a peripheral speed of 30 m/sec to effect a pre-treatment. Then, the resultant mixture was further treated in an apparatus as shown in FIG. 2A for 1 min. under the conditions of a blade-tip peripheral speed of 70 m/sec, a minimum clearance of 1 mm and a process temperature of 45° C., thereby to obtain particles (A2).

Then, 100 parts of the above-prepared particles (A2) and 12 parts of polymethyl methacrylate fine particles (C) with a volume-average particle size of 11 microns were charged in a Henschel mixer (FM10B) and stirred for 3 min. at a peripheral speed of 30 m/sec to effect a pre-treatment. Then, the resultant mixture was further treated in an apparatus as shown in FIG. 2A for 5 min. under the conditions of a peripheral speed of 70 m/sec, a minimum clearance of 1 mm and a process (inside) temperature of 65° C., thereby to obtain a microcapsule toner with a coverage of the particles (A2) by the particles (C) of 82.5% as calculated.

A developer was prepared by using the microcapsule toner and subjected to image formation in the same manner as in Example 12, whereby a good fixing performance was exhibited including satisfying anti-offset characteristic and anti-winding characteristic at a temperature (fixing roller surface temperature) of 180° C.

EXAMPLE 16

| | |
|---|---|
| Styrene-butylacrylate-divinylbenzene copolymer (Mw = 3 × $10^5$) | 100 parts |
| Nigrosin (Orient Kagaku K.K.) | 2 parts |
| Magnetite (BET 8 $m^2/g$, pH = 7.2, oil absorption 28 ml/100 g) | 60 parts |

The above ingredients were kneaded at 150° C. for 30 min., and the kneaded product was cooled and pulverized to a volume-average particle size of about 10 microns, followed by removal of fine powder by a zig-zag classifier (Alpine Co.) so as to provide a volume-average particle size of about 11 microns, thereby to obtain particles (A1). The softening point of the particles (A1) was 25° C.

Then, 100 parts of the above-prepared particles (A1) and 0.5 part of polyethylene fine particles (B) with a volume-average particle size of 1 micron were charged in a Henschel mixer (FM10B) and stirred for 1 min. at a peripheral speed of 30 m/sec to effect a pre-treatment. Then, the resultant mixture was further treated in an apparatus as shown in FIG. 2A for 1 min. under the conditions of a blade-tip peripheral speed of 70 m/sec, a minimum clearance of 1 mm and a process temperature of 47° C., thereby to obtain particles (A2) with a volume-average particle size of 11 microns.

Then, 100 parts of the above-prepared particles (A2) and 20 parts of polymethyl methacrylate fine particles (C) with an average particle size of 11 microns were charged in a Henschel mixer (FM10B) and stirred for 1 min. at a peripheral speed of 30 m/sec to effect a pre-treatment. Then, the resultant mixture was further treated in an apparatus as shown in FIG. 2A for 5 min. under the conditions of a blade-tip peripheral speed of 70 m/sec, a minimum clearance of 1 mm and a process temperature of 67° C., thereby to obtain a microcapsule toner with a coverage of 87% as calculated.

100 parts of the microcapsule toner was externally mixed with 0.5 part of colloidal silica treated with aminosilicone oil to form a one-component developer.

The developer was subjected to image formation by using a copying machine (NP-3525, Canon K.K.), whereby good images were obtained. Toner images thus formed on plain paper were fixed by a fixing device for a copying machine (NP7550, Canon K.K.) at a temperature (fixing roller surface temperature) of 180° C., whereby a good fixing performance was exhibited including satisfactory anti-offset characteristic and antiwinding characteristic.

COMPARATIVE EXAMPLE 7

0.5 part of polyethylene fine particles (B) with a volume-average particle size of 1 micron were mixed with 100 parts of the particles (A1) obtained in Example 16, and the mixture was kneaded by a roll mill. The kneaded product was cooled and pulverized to a volume-average particle size of about 11 microns, followed by removal of fine powder by a zig-zag classifier (Alpine Co.) so as to provide a volume-average particle size of about 10 microns, thereby to obtain a toner.

0.4 part of colloidal silica treated with amino-modified silicone oil was externally mixed with 100 parts of the toner to prepare a one-component developer. The developer was subjected to image formation by using a copying machine (NP-3525), whereby good images were obtained. However, when non-fixed images on plain paper were fixed by a fixing device for a copying machine (NP-7550), poor anti-offset characteristic and anti-winding characteristic were exhibited at a fixing temperature (roller surface temperature) of 180° C.

COMPARATIVE EXAMPLE 8

A toner was prepared in the same manner as in Comparative Example 7 except for using 100 parts of the particles (A1) prepared in Example 14 and 0.4 part of silica treated with amino-modified silicone oil. The toner was subjected to the same fixing test, whereby poor anti-offset characteristic and anti-winding characteristic were exhibited at a fixing temperature (roller surface temperature) of 180° C.

EXAMPLE 17

Preparation of Colored Particles (A1)

| | |
|---|---|
| Styrene monomer | 170 parts |
| 2-Ethylhexyl acrylate | 30 parts |
| Cyclized rubber (Albex EK-450, mfd. by Hoechst Japan, K.K.) | 15 parts |
| Vinyl-type crosslinking agent (NK-Eqter 2G, Shin-Nakamura Kagaku K.K.) | 1 parts |
| Carbon black (STERING R, Cabot Co., U.S.) | 30 parts |
| Paraffin wax (Nihon Seiro K.K.) | 10 parts |

The above ingredients were mixed at 60° C. for 4 hours by means of an attritor to prepare a monomer mixer, to which were further added 10 parts of 2,2'-azobis-(2,4-dimethylvaleronitrile) and 1 part of 2,2'-azobisisobutyronitrile to prepare a monomer composition. Separately, an aqueous medium was prepared by adding 10 parts of amino-modified silica (obtained by treating 100 parts of Aerosil #200 with 5 parts of aminopropyltriethoxysilane) and 15 parts of 0.1N-hydrochloric acid into 1200 parts of deionized water. Into the aqueous medium warmed at 60° C. under stirring by means of a TK-homomixer, the above-prepared monomer composition was charged, and then the homomixer was stirred for 30 min. at 9,000 rpm for dispersion and granulation. Then, the stirring means was changed from the homomixer to a paddle blade stirrer, and the stirring was continued for 10 hours at 60° C. to complete the polymerization. After cooling, the polymer particles were washed with a sodium hydroxide solution to remove the amino-modified silica. The polymer particles were further washed with water and, dehydrated two times and then, dried at 40° C. for 24 hours and classified to obtain particles (A1) having a volume-average particle size of 10.0 microns.

Preparation of Abrasive Particles (B)

A coarse powder fraction was removed from cerium oxide (consisting principally of $CeO_2$) by a wind-force classifier.

Preparation of Shell-Forming Particles (C)

| | |
|---|---|
| Styrene monomer | 85 parts |
| Cyclized rubber | 10 parts |
| Chromium complex of di-tert-butylsalicylic acid | 7 parts |

The above ingredients were dispersed for 4 hours under heating at 60° C. by an attritor to form a monomer mixture, to which 5 parts of 2,2'-azobis-(2,4-dimethylvaleronitrile was added to prepare a monomer composition. Into a 2 liter-stainless steel vessel containing 10 parts of the same amino-modified silica, 600 parts of distilled water and 15 parts of 1/10N-hydrochloric acid, the above-prepared monomer composition was added, and the mixture was stirred at 60° C. by a TK-homomixer (mfd. by Tokushu Kika Kogyo) rotating at 9,000 rpm for 30 min. for preliminary dispersion to prepare a liquid dispersion. The dispersion was then subjected to granulation by means of a piston-type high pressure homogenizer (Model 15M8TA, mfd. by Gaulin Corp.) at an ejection pressure of 400 kg/cm$^2$. After the granulation, the dispersion was subjected to 10 hours of stirring by a paddle blade stirrer at 60° C. to complete the polymerization.

After cooling, the product was washed with sodium hydroxide solution, washed with water and dehydrated two times and then dried to obtain particles (C) having a volume-average particle size of 1.5 micron.

Then, 100 parts of the above-prepared colored particles (A1) and 20 parts of the above-prepared particles (B) were charged in a Henschel mixer (FM10B, mfd. by Mitsui Miike Seisakusho K.K.) as shown in FIG. 1 and stirred for 3 min. at a peripheral speed of the stirring vane of 50 m/sec to effect a pretreatment. Then, the resultant mixture was further treated in an apparatus as shown in FIG. 2A for 5 min. under the conditions of a blade-tip peripheral speed of 60 m/sec, a minimum clearance of 1 mm and a process temperature of 50° C., thereby to obtain particles (A2). As a result of observation of the colored particles (A2) through an electron microscope, it was observed that the abrasive particles (B) were partially fixed onto the particles (A1). The coverage at that time was 75%.

100 parts of the thus obtained colored particles (A2) and 40 parts of the above-obtained shell-forming particles (C) were again charged in the Henschel mixer shown in FIG. 1 and stirred for 3 min. at a peripheral speed of 30 m/sec to effect a pretreatment.

The pretreated mixture was further treated in the apparatus shown in FIG. 2A for 3 min. under the conditions of a black peripheral speed of 50 m/sec, a minimum clearance of 1 mm and a process temperature of 50° C., thereby to obtain a microcapsule toner. The microcapsule toner particles were observed through an electron microscope, whereby about 90% of the surfaces of the particles (A2) were covered by the shell formed by the particles (C).

100 parts of the microcapsule toner was mixed with 0.5 part of colloidal silica treated with aminosilicone oil and 0.1 part of polyvinylidene fluoride particles (volume-average particle size=3.5 microns), and 10 parts of the mixture (toner) was mixed with 100 parts of ferrite carrier (obtained by coating ferrite particles of 250–300 mesh with a silicone resin) to form a two-component developer. The triboelectric charge of the toner was measured to be −20 uC/g under the normal temperature-normal humidity conditions (23 ° C., 65%RH).

The developer was used for image formation by using a copying apparatus which had been obtained by remodeling a commercially available copying machine (NP-270RE, mfd. by Canon K.K.) so as to be adapted to a two-component developer, whereby image defects such as fog and image flow were not observed. Further, the image density was stably 1.4 from the initial stage of successive copying operation. After the successive copying operation, the photosensitive drum was observed, whereas no sticking of the microcapsule toner was observed.

EXAMPLE 18

The same particles (A1) and particles (B) as in Example 17 were used and treated in the same manner to obtain colored particles (A2).

Preparation of Colored Particles (C)

| | |
|---|---|
| Styrene monomer | 100 parts |
| Styrene-dimethylaminoethyl methacrylate copolymer (copolymerization ratio = 7:3, Mw = $10^4$) | 25 parts |

The above ingredients were mixed at 80° C. for 4 hours by means of an attritor to prepare a monomer mixture. Separately, an aqueous medium was prepared by adding 2 parts of 2,2'-azobis-(2,4-dimethylvaleronitrile), 10 parts of amino-modified silica and 20 parts of 0.1N-hydrochloric acid into deionized water. Into the aqueous medium warmed at 70° C. under stirring by means of a TK-homomixer, the above-prepared monomer composition was charged, and then the homomixer was stirred for 40 min. at 9,000 rpm for dispersion and granulation. The dispersion was then subjected to granulation by means of a piston-type high pressure homogenizer (Model 15M-8TA, mfd. by Gaulin Corp.) at an ejection pressure of 400 kg/cm$^2$. After the granulation, the dispersion was subjected to 10 hours of stirring by a paddle blade stirrer at 60° C. to complete the polymerization.

After cooling, the product was washed with sodium hydroxide solution to remove the amino-modified silica, washed and dehydrated two times, and dried to obtain particles (C), which were found to have a volume-average particle size of 0.9 micron.

Then, 100 parts of the above-prepared colored particles (A2) and 25 parts the shell-forming resin particles (C) were subjected to the pre-treatment in the Henschel mixer in the same manner as in Example 17. Thereafter, the resultant mixture was subjected to the same fixing operation as in Example 17 to obtain a microcapsule toner, wherein the shell-forming particles (C) were fixed onto the colored particles (A2). Observation through an electron microscope showed that about 90% of the surface of the particles (A2) were covered by the particles (C).

The microcapsule toner was externally mixed with the same colloidal silica and polyvinylidene fluoride in the same manner as in Example 17 to form a toner. Then, 10 parts of the toner was mixed with 100 parts of the same carrier as in Example 1 to form a developer.

The developer was subjected to successive copying operation by using a copying machine obtained by the developing device of a commercial machine (NP-3525, Canon K.K.) under high temperature-high humidity conditions (32° C., 65%RH), whereby the resultant images stably showed image densities in the range of 1.20–1.25 and were free from fog and image flow. After 5000 sheets of copying, the photosensitive drum was observed, whereby the surface thereof were uniformly abraded and no sticking of toner was observed. The microcapsule toner showed a triboelectric charge of +18 μC/g under the conditions of 23° C. and 65%RH, and also showed a satisfactory fluidity.

EXAMPLE 19

Particles (A1) were prepared in the following manner.

| | |
|---|---|
| Paraffin wax (PF155, mfd. by Nihon Seiro K.K.) | 200 parts |
| Polyethylene (Hi-Wax 200P, Mitsui Sekiyu Kagaku K.K.) | 80 parts |
| Magnetite (BL-250, Titan Kogyo K.K.) | 140 parts |

The above ingredients were melt-mixed at 150° C. and sprayed through a dual-fluid nozzle with a setair temperature of 120° C., followed by cooling and solidification to obtain particles (A1) with a volume-average particle size of 10.5 microns.

Abrasive particles (B) were obtained by passing powdery strontium titanate ($SrTiO_3$) through a window force classifier to recover a fraction having a volume-average particle size of 1.0 micron. Particles (C) were the same as in Example 18.

The above-prepared particles (A1) and particles (B) were subjected to the same pre-treatment as in Example 17 and then subjected to the fixing treatment in the apparatus shown in FIG. 2A under the conditions of a process temperature of 50° C., a process time of 4 min. and a minimum clearance of 1 mm, thereby to obtain colored particles (A2) with a coverage by the strontium titanate fine particles of about 70%. Then, 100 parts of the particles (A2) and the particles (C) used in Example 18 were mixed at a weight ratio of 100:25 (set film thickness=0.5 micron) and pretreated for 3 min. in the Henschel mixer at a peripheral speed of 40 m/sec. The pretreated mixture was further subjected to the fixing treatment in the apparatus shown in FIG. 2A for a process time of 3 min. to obtain a microcapsule toner. The microcapsule toner was externally mixed with 0.6 part of colloidal silica and 0.4 part of zinc stearate to prepare a one-component developer. The developer showed a triboelectric charge of +22 μC/g. Observation through an electron microscope showed that the surface of the particles (A2) was sufficiently covered (coverage=100 with the particles (C). The shape of each microcapsule toner particle was a substantially uniform sphere.

The one-component developer comprising the microcapsule toner was subjected to image formation by using a copying machine (PC-9, Canon K.K.), whereby the resultant images were satisfactory in any respects of image clarity, fog, and image density. No sticking of the microcapsule toner on the photosensitive drum was observed up to 2000 sheets of copying.

EXAMPLE 20

Particles (A1) were prepared in the same manner as in Example 17 except that C.I. Basic Red I (C.I. 45160) was used instead of the carbon black used in Example 17. The same particles (B) and (C) as used in Example 18 were used. The same fixing operations as in Example 18 were performed to obtain a microcapsule toner.

100 parts of the microcapsule toner, 0.6 part of colloidal silica and 0.3 part of zinc stearate were mixed in Henschel mixer. Then, 10 parts of the mixture (toner) was mixed with 100 parts of ferrite carrier (obtained by coating ferrite particles of 250–300 mesh with fluoride-containing resin and acrylic resin) to form a two-component developer. The toner at that time showed a triboelectric charge of +20 μC/g in the environment of 23° C. and 65%RH. The developer was charged in a color cartridge for a copying machine (PC-7, Canon K.K.) and used for continuous copying for 3000 sheets in the environment of 32° C. and 20%RH, whereby good images were always obtained.

EXAMPLE 21

A microcapsule toner was prepared in the same manner as in Example 17 except that the strontium titanate ($SrTiO_3$) fine powder was used after being treated with a silane coupling agent. The resultant microcapsule toner was evaluated also in the same manner. As a result of the image formation, the images obtained were satisfactory in any respects of density, fog and image flow.

COMPARATIVE EXAMPLE 9

A developer was prepared in the same manner as in Example 17 except that the particles (B) were not used. The developer showed a triboelectric charge of −18 μC/g. The developer was used for image formation in the same manner as in Example 17, whereby black spots were observed on copied images from the 500 sheets or thereafter due to insufficient cleaning of the photosensitive drum.

REFERENCE EXAMPLE

A microcapsule toner was prepared in the same manner as in Example 17 except that the amount of the particles (C) was reduced to 10 parts with respect to 100 parts of the particles (A2). Observation through an electron microscope of the microcapsule toner showed that about 20% of the surface of the particles (A2) was covered by the particles (C). The microcapsule toner was similarly subjected to the external mixing of the silica, etc., and image formation in the same manner as in Example 17, whereby the resultant images were accompanied with much fog and showed a low image density of 1.0. The triboelectric charge at that time was −4 μC/g As described above, the microcapsule toner produced by the present invention does not cause sticking of the toner onto a photosensitive drum but provides good images stable image density and free from fog even in continuous copying. The encapsulation process according to the present invention is substantially dry, so that a troublesome system such as recovery of an organic solvent can be omitted and the production cost can be economized. The process also provides a microcapsule toner which fully exhibits the respective ingredients thereof.

What is claimed is:

1. A process for producing a microcapsule toner, comprising:

passing resinous base particles (A1) comprising at least a binder resin and modifier particles (B) having a particle size ratio of 0.2 or less with respect to the base particles (Al) through an impact zone having a minimum clearance of 0.5–5 mm between a rotating member and a fixed member or between at least two rotating members at a first ambient temperature of 40°–55° C. to thereby fix the modifier particles (B) onto the surfaces of the base particles (A1) under the action of a mechanical impact force to form particles (A2), the modifier particles (B) being particles selected from the group consisting of charge-controlling particles, releasing particles, colored particles, charge-suppressing particles and abrasive particles; and passing the particles (A2) and shell-forming resin particles (C), said shell-forming resin particles (C) in an amount sufficient to provide a shell coverage of 51–100% and having a particle size ratio of 0.2 or less with respect to the particles (A2), through an impact zone having a minimum clearance of 0.5–5 mm between a rotating member and a fixed member or between at least two rotating members at a second ambient temperature of 45°–80° C., said second ambient temperature being higher than the first ambient temperature to fix the shell-forming resin particles onto the surfaces of the particles to form a shell, thus obtaining a microcapsule toner.

2. A process according to claim 1, wherein the microcapsule toner has a shell coverage of 80–100%.

3. A process according to claim 1, wherein the microcapsule toner has a shell coverage of 95–100%.

4. A process according to claim 1, wherein the particles (A1) have a volume-average particle size of 2 –20 microns, and the particles (B) have an average particle size ratio of 0.2 or less with respect to the particles (A1).

5. A process according to claim 1, wherein the particles (B) are first mixed with silica fine powder and then fixed onto the particles (A1).

6. A process according to claim 1, wherein the particles (C) are first mixed with silica fine powder and then fixed onto the particles (A2).

7. A process according to claim 1, wherein the particles (B) are fixed onto the particles (A1) and the particles (C) are then fixed onto the particles (A2), respectively, under the condition providing a minimum clearance of 1–3 mm between a rotating member and a fixed member.

8. A process according to claim 1, wherein the particles (B) are fixed onto the particles (A1) and the particles (C) are then fixed onto the particles (A2), respectively, under the condition providing a minimum clearance of 1–3 mm between two rotating members.

9. A process according to claim 1, wherein the particles (A1) comprise spherical particles prepared by suspension polymerization.

10. A process according to claim 1, wherein the particles (B) comprise spherical particles prepared by suspension polymerization.

11. A process according to claim 1, wherein the particles (C) comprise spherical particles prepared by suspension polymerization.

12. A process according to claim 1, wherein the particles (C) are fixed onto the particles (A2) to provide a microcapsule toner having a shell thickness of 0.01–2.0 microns.

13. A process according to claim 1, wherein the particles (C) are fixed onto the particles (A2) to provide a microcapsule toner having a shell thickness of 0.05–1.0 micron.

14. A process according to claim 1, wherein the particles (A1) have a pseudo-capsule structure.

15. A process according to claim 1, wherein the charge-suppressing particles (B) show a resistivity of $10^{-2}$–$10^{13}$ ohm/cm.

16. A process according to claim 15, wherein the charge-suppressing particles (B) comprise particles of a material selected from the group consisting of iron, cobalt, nickel, iron alloy, cobalt alloy, nickel alloy, magnetite, hematite, ferrite, $SnO_2$, ZnO, $Fe_2O$, $Al_2O_3$, CaO, BaO, MgO, $TiO_2$, TiO, $SnO_2$—$TiO_2$, $SnO_2$—$BaSO_4$, $SiO_2$, $SrTiO_3$ and carbon black.

17. A process according to claim 15, wherein the charge-suppressing particles (B) comprise colorless or pale powder of a material selected from the group consisting of $ZnO_2$, $SiO_2$, $TiO_2$, $Al_2O_3$ and $SrTiO_3$

18. A process according to claim 1, wherein the charge-suppressing particles (B) show a resistivity of $10^{-2}$–$10^{4}$ ohm/cm.

19. A process according to claim 18, wherein the charge-suppressing particles (B) are used in na amount of 0.1–10 wt. parts per 100 wt. parts of the particles (A1).

20. A process according to claim 1, wherein the colored particles (B) comprise particles of a pigment and/or a dye.

21. A process according to claim 1, wherein the colored particles (B) comprise a resin and a colorant.

22. A process according to claim 21, wherein the colored particles have been formed by suspension polymerization.

23. A process according to claim 21, wherein the colorant is a pigment and/or a dye and is mixed in a weight ratio of 1:99–99:1 with the resin.

24. A process according to claim 23,wherein the colorant is mixed in a weight ratio of 5:95–95:5 with the resin.

25. A process according to claim 1, wherein the colored particles (B) are fixed onto the particles (A1) to provide a coverage of 1–100%.

26. A process according to claim 1, wherein the charge-controlling particles (B) comprise a positive charge controller or negative charge controller which is solid at least at a temperature of 20°–90° C.

27. A process according to claim 1, wherein the charge-controlling particles (B) comprise a resin and a positive or negative charge controller.

28. A process according to claim 1, wherein the charge-controlling particles (B) are used in a proportion of 0.01–10 wt. parts per 100 wt. parts of the particles (A1).

29. A process according to claim 1, wherein the charge-controlling particles (B) are used in a proportion of 0.05–2 wt. parts per 100 wt. parts of the particles (A1).

30. A process according to claim 1, wherein the charge-controlling particles have a triboelectric chargeability of 3 $\mu C/g$ or move in terms of an absolute value.

31. A process according to claim 1, wherein the charge-controlling particles have a triboelectric chargeability of 7 $\mu C/g$ or more in terms of an absolute value.

32. A process according to claim 1, wherein the abrasive particles comprise powder of a material showing a Mohs hardness of 3 or higher selected from the group consisting of inorganic metal oxides, inorganic metal nitrides, inorganic metal carbides, inorganic metal sulfates and inorganic metal carbonates.

33. A process according to claim 1, wherein the abrasive particles (B) comprises powder of an inorganic compound selected from the group consisting of $SiO_2$, $SrTiO_2$, $CeO_2$, CrO, $Al_2O_3$, MgO, $Si_3N_4$, SiC, $CaSO_4$, $BaSO_4$ and $CaCO_3$.

34. A process according to claim 1, wherein the abrasive particles (B) are fixed onto the particles (A1) to provide a coverage of 10–100%.

35. A process according to claim 1, wherein the abrasive particles (B) are used in a proportion of 0.1 –30 wt. parts per 100 wt. parts of the particles (A1).

36. A process according to claim 1, wherein the releasing particles (B) have a softening point of 40–130° C.

37. A process according to claim 1, wherein the releasing particles (B) have a softening point of 50–120° C.

38. A process according to claim 1, wherein the releasing particles (B) are used in a proportion of 0.1 –5 wt. parts per 100 wt. parts of the particles (A1).

39. A process according to claim 1, wherein the particles (A1) comprise crosslinked styrene-acrylic-type copolymer or crosslinked polyester resin as the binder resin.

40. A process according to claim 1, wherein the particles (C) comprise crosslinked styrene-acrylic-type copolymer or crosslinked polyester resin.

41. The process according to claim 1, wherein the rotating member rotates at a peripheral speed of 30–150 m/sec.

42. The process according to claim 1, wherein the base particles (A1) and the modifier particles (B) are pre-treated in a mixer before the fixation of the modifier particles.

43. The process according to claim 1, wherein the particles (A2) and the shell-forming resin particles (C) are pre-treated in a mixer before the fixation of the modifier particles.

44. A process according to claim 1, wherein the second ambient temperature is higher by at least 5° C. than the first ambient temperature.

* * * * *

UNITED STATES PATENT AND TRADEMARK OFFICE

CERTIFICATE OF CORRECTION

PATENT NO. :5,215,854

DATED :June 1, 1993

INVENTOR(S) :MASUO YAMAZAKI, ET AL.

It is certified that error appears in the above-identified patent and that said Letters Patent is hereby corrected as shown below:

COLUMN 1

Line 38, "such" should read --such a--.

COLUMN 2

Line 6, "deteriorate." should read --deteriorates.--.
Line 10, "deteriorates" should read --deteriorate--.

COLUMN 3

Line 60, "a" should be deleted.

COLUMN 5

Line 65, "of" (second occurrence) should read --of the--.

COLUMN 6

Line 4, "dominanat," should read --dominant,--.
Line 7, "while it is insufficient" should be deleted.
Line 19, "of" should read --or--.

COLUMN 7

Line 14, "causes" should read --causes an--.

COLUMN 8

Line 23, "shell-temperature forming" should read --shell-forming--.

UNITED STATES PATENT AND TRADEMARK OFFICE

CERTIFICATE OF CORRECTION

PATENT NO. : 5,215,854

DATED : June 1, 1993

INVENTOR(S) : MASUO YAMAZAKI, ET AL.

It is certified that error appears in the above-identified patent and that said Letters Patent is hereby corrected as shown below:

COLUMN 10

Line 2, "(kokai)" should read --(Kokai)--.
Line 56, "80-100%, charging" should read --80-100%, further preferably 95-100%. As a result, excessive charging--.

COLUMN 11

Line 35, "particles" should read --particle--.
Line 51, "or exceeding" should read --or (A2); $M_2$, the true density of the particles (B) or (C). ¶ If the above calculation provides a coverage exceeding--.

COLUMN 12

Line 30, "volume-basic" should read --volume-basis--.
Line 34, "Incidentally" should read --Incidentally,--.
Line 48, "and $TiO_2$," should read --and carbon black. Colorless or pale powder of $ZnO_2$, $SiO_2$, $TiO_2$,--.
Line 55, "3.1 cm dia." should read --3.1 cm-dia.--.

COLUMN 13

Line 42, "black" should read --black,--.

COLUMN 14

Line 63, "comprises" should read --comprise--.

UNITED STATES PATENT AND TRADEMARK OFFICE

CERTIFICATE OF CORRECTION

PATENT NO. :5,215,854

DATED :June 1, 1993

INVENTOR(S) :MASUO YAMAZAKI, ET AL.

It is certified that error appears in the above-identified patent and that said Letters Patent is hereby corrected as shown below:

COLUMN 15

Line 28, "are" should read --and--.
Line 29, "and" should read --are--.
Line 36, "7 C/g" should read --7 μC/g--.

COLUMN 16

Line 46, "in" should read --is--.

COLUMN 17

Line 29, "facilitating" should read --facilitate--.
Line 61, "charge" should read --change--.

COLUMN 18

Line 4, "are" should read --as--.

COLUMN 20

Line 8, "functions" should read --function--.

COLUMN 24

Line 19, "acid" (first occurrence) should read --acid,--.

COLUMN 29

Line 47, "characteristics" should read --characteristic--.

UNITED STATES PATENT AND TRADEMARK OFFICE

CERTIFICATE OF CORRECTION

PATENT NO. : 5,215,854

DATED : June 1, 1993

INVENTOR(S) : MASUO YAMAZAKI, ET AL.

It is certified that error appears in the above-identified patent and that said Letters Patent is hereby corrected as shown below:

COLUMN 31

Line 24, "1/10Nhydrochloric" should read --1/10N-hydrochloric--.

Line 51, "2,2,'-azobis-(2,4-dimethylvaleronitrile" should read --2,2,'-azobis-(2,4-dimethylvaleronitrile)--.

COLUMN 32

Line 58, "an" should read --and--.

COLUMN 33

Line 44, "that" should read --than--.

COLUMN 34

Line 18, "10 min." should read --10 min.,--.

COLUMN 38

Line 16, "0.1Nhydrochloric" should read --0.1N-hydrochloric--.

Line 32, "was" should read --were--.

Line 62, "a" should read --an--.

COLUMN 39

Line 62, "has" should read --have--.

Line 66, "nigrosin" should read --nigrosine--.

UNITED STATES PATENT AND TRADEMARK OFFICE

CERTIFICATE OF CORRECTION

PATENT NO. : 5,215,854

DATED : June 1, 1993

INVENTOR(S) : MASUO YAMAZAKI, ET AL.

It is certified that error appears in the above-identified patent and that said Letters Patent is hereby corrected as shown below:

COLUMN 40

Line 22, "was" should read --were--.

COLUMN 41

In Table, "TABLE" should read --TABLE 1--.
In Table, Ex. No. 7, "nigrosin" should read --nigrosine--.
In Table, Ex. No. 8, "nigrosin" should read --nigrosine--.
In Table, Ex. No. 9, "nigrosin" should read --nigrosine--.
In Table, Ex. No. 11, "11.0/11.0" should read --10.0/11.0--.

COLUMN 43

Line 9, "2 micron" should read --2 microns--.
Line 55, "1 parts" should read --1 part--.

COLUMN 45

EXAMPLE 16, "Nigrosin" should read --Nigrosine--.

COLUMN 46

EXAMPLE 17, "1 parts" should read --1 part--.

COLUMN 48

Line 63, "were" should read --was--.

UNITED STATES PATENT AND TRADEMARK OFFICE

CERTIFICATE OF CORRECTION

PATENT NO. : 5,215,854

DATED : June 1, 1993

INVENTOR(S) : MASUO YAMAZAKI, ET AL.

It is certified that error appears in the above-identified patent and that said Letters Patent is hereby corrected as shown below:

COLUMN 49

Line 14, "setair" should read --set-air--.
Line 44, "100" should read --100%)--.

COLUMN 50

Line 40, "−4 μC/g" should read -- −4 μC/g.--.
Line 44, "images" should read --images with--.

COLUMN 51

Line 7, "particles (A2)," should read --particles (A2)--.
Line 14, "particles" (second occurrence) should read --particles (A2) under the action of a mechanical impact force--.

COLUMN 52

Line 11, "na" should read --an--.
Line 25, "claim 23,wherein" should read --claim 23, wherein--.

UNITED STATES PATENT AND TRADEMARK OFFICE

CERTIFICATE OF CORRECTION

PATENT NO. : 5,215,854

DATED : June 1, 1993

INVENTOR(S) : MASUO YAMAZAKI, ET AL.

It is certified that error appears in the above-identified patent and that said Letters Patent is hereby corrected as shown below:

COLUMN 52

Line 48, "move" should read --more--.
Line 59, "comprises" should read --comprise--.

Signed and Sealed this

Sixth Day of September, 1994

Bruce Lehman

*Attest:*

BRUCE LEHMAN

*Attesting Officer*

*Commissioner of Patents and Trademarks*